US012382988B2

(12) United States Patent
Yang

(10) Patent No.: US 12,382,988 B2
(45) Date of Patent: Aug. 12, 2025

(54) CIGAR CUTTER WITH POSITIONING MECHANISM FOR SELECTIVELY KEEPING THE SAME IN OPEN OR CLOSED STATE

(71) Applicant: Chun-Kai Yang, Taipei (TW)

(72) Inventor: Chun-Kai Yang, Taipei (TW)

( * ) Notice: Subject to any disclaimer, the term of this patent is extended or adjusted under 35 U.S.C. 154(b) by 570 days.

(21) Appl. No.: 17/893,139

(22) Filed: Aug. 22, 2022

(65) Prior Publication Data

US 2023/0329333 A1 Oct. 19, 2023

(30) Foreign Application Priority Data

Apr. 15, 2022 (TW) ..... 111114566
Jul. 13, 2022 (TW) ..... 111126270

(51) Int. Cl.
*A24F 13/26* (2006.01)

(52) U.S. Cl.
CPC ..... *A24F 13/26* (2013.01)

(58) Field of Classification Search
CPC ..... A24F 13/24; A24F 13/26
USPC ..... 30/109–113; D27/195; 131/248–253
See application file for complete search history.

(56) References Cited

U.S. PATENT DOCUMENTS 209,387 A * 10/1878 Dillmeier ..... A24F 13/26 131/253
232,864 A * 10/1880 Wienhold ..... A24F 13/26 30/112
242,340 A * 5/1881 Lieb ..... A24F 13/26 30/112
242,690 A * 6/1881 Petzold ..... A24F 13/26 30/112
513,581 A * 1/1894 La Pierre ..... A24F 13/26 30/112
599,878 A * 3/1898 Tabb ..... A24F 13/26 30/112
607,167 A * 7/1898 Fontneau ..... A24F 13/26 30/112
788,425 A * 4/1905 Parris ..... A24F 13/26 30/112
819,875 A * 5/1906 Garrigus ..... A24F 13/26 30/112

(Continued)

FOREIGN PATENT DOCUMENTS

CA 2124510 A1 * 11/1995 ..... A24F 13/24
CN 1870914 B 5/2012

(Continued)

*Primary Examiner* — Jason Daniel Prone
(74) *Attorney, Agent, or Firm* — CIPO IP Group

(57) ABSTRACT

A cigar cutter with a positioning mechanism keeping it in an open or closed state includes a rotatable ring, an elastic element, an arresting block and a guide track. Pressing the cigar cutter's cutting blade unit(s) drives the rotatable ring to rotate to compress the elastic element, and the arresting block touches an abutting block and a shoulder in the guide track and is engaged to one end of the guide track, so the cigar cutter is in the closed state. Pressing the cutting blade unit(s) again drives the rotatable ring to rotate to compress the elastic element, the arresting block again touches the abutting block and shoulder and is out of the engaged state, and the elastic element drives the rotatable ring to rotate reversely, which moves the arresting block to the other end of the guide track and allows the cigar cutter to enter the open state.

16 Claims, 23 Drawing Sheets

(56) References Cited

U.S. PATENT DOCUMENTS 835,912 A * 11/1906 Obermayer ..... A24F 13/26 30/112
838,205 A * 12/1906 Nobs, Jr. ..... A24F 13/26 30/112
855,203 A * 5/1907 Schickerling ..... A24F 13/26 30/112
881,125 A * 3/1908 Holmquist ..... B26B 11/00 30/112
950,692 A * 3/1910 Garrigus ..... A24F 13/26 30/112
1,096,219 A * 5/1914 Bippart ..... A24F 13/26 30/112
1,100,364 A * 6/1914 Fontneau et al. ..... A24F 13/26 30/112
1,107,950 A * 8/1914 Holsen ..... B26B 11/00 30/112
1,111,743 A * 9/1914 Graboff ..... A24F 13/26 30/112
1,124,288 A * 1/1915 Bulman ..... A24F 13/26 30/112
1,177,098 A * 3/1916 Gay ..... A24F 13/26 30/112
1,186,291 A * 6/1916 Davis ..... A24F 13/26 30/112
1,454,994 A * 5/1923 De Matteo ..... A24F 13/26 30/112
1,504,589 A * 8/1924 Wagner et al. ..... A24F 13/26 30/112
3,232,298 A * 2/1966 Tomlinson ..... A24F 13/24 131/253
3,903,598 A * 9/1975 Lefebvre ..... A24F 13/26 30/109
D244,390 S * 5/1977 Zimmermann ..... D27/195
5,303,721 A * 4/1994 Bowen ..... A24F 13/20 131/248
5,694,691 A * 12/1997 Chen ..... A24F 13/26 30/112
5,893,212 A * 4/1999 Meister ..... A24F 13/26 30/113
5,937,523 A * 8/1999 Van Keppel ..... A24F 13/26 30/112
5,974,668 A * 11/1999 Butzer ..... A24F 13/24 30/112
5,992,022 A * 11/1999 Carrera Moya ..... A24F 13/24 30/113
6,076,260 A * 6/2000 Williamson, IV ..... A24F 13/26 30/113
6,164,286 A * 12/2000 Schad ..... A24F 13/26 30/109
D623,352 S * 9/2010 Melgaard ..... D27/195
9,119,422 B2 * 9/2015 Lance ..... A24F 13/26
9,883,694 B2 * 2/2018 Almsberger ..... A24F 13/26
10,201,184 B1 * 2/2019 Fischer ..... A24F 13/24
10,736,353 B1 * 8/2020 Sharp ..... A24F 13/26
10,820,628 B2 * 11/2020 France ..... A24F 13/26
11,083,218 B1 * 8/2021 Mandeville ..... A24F 13/26
11,344,061 B2 * 5/2022 Rodriguez ..... A24F 13/26
11,856,984 B2 * 1/2024 Fisten ..... A24F 13/26
2007/0089299 A1 * 4/2007 Belaubre ..... A24F 13/26 30/112
2009/0113719 A1 * 5/2009 Smith ..... A24F 13/26 30/113
2010/0257741 A1 * 10/2010 Lin ..... A24F 13/26 30/112
2019/0380384 A1 12/2019 France
2023/0397656 A1 * 12/2023 Yang ..... A24F 13/26
2024/0000139 A1 * 1/2024 Vezina ..... A24F 13/24
2024/0245111 A1 * 7/2024 Senci ..... A24F 13/26
2024/0381931 A1 * 11/2024 Wright ..... A24F 13/26

FOREIGN PATENT DOCUMENTS

CN 109007973 A 12/2018
DE 943622 C * 5/1956 ..... A24F 13/26
FR 573811 A * 6/1924 ..... A24F 13/26
FR 2480573 A1 * 10/1981 ..... A24F 13/26
FR 2821580 A1 * 9/2002 ..... A24F 13/26
FR 2827538 B1 * 10/2003 ..... A24F 13/26
GB 189707129 A * 5/1897 ..... A24F 13/24
GB 191119033 A * 6/1912 ..... A24F 13/26
JP 11018745 A * 1/1999 ..... A24F 13/24
TW 201817324 A 5/2018

* cited by examiner

CIGAR CUTTER WITH POSITIONING MECHANISM FOR SELECTIVELY KEEPING THE SAME IN OPEN OR CLOSED STATE

CROSS-REFERENCE TO RELATED PATENT APPLICATION

This non-provisional application claims priority to and the benefit of, under 35 U.S.C. § 119(a). Taiwan Patent Application No. 111114566, filed Apr. 15, 2022 in Taiwan, and Taiwan Patent Application No. 111126270, filed Jul. 13, 2022 in Taiwan. The entire content of the above identified applications is incorporated herein by reference.

FIELD

The present disclosure is related to a cigar cutter, and more particularly to a cigar cutter provided therein with a guide track and an arresting block that rotates when being moved in the guide track to change its length corresponding to two opposite sides of the guide track, so as to position the cigar cutter in a closed state.

BACKGROUND

Although expensive, cigars have been more and more popular thanks to the rise of the standard of living. A cigar generally has a closed end (i.e., the cap). Before smoking a cigar, therefore, a smoker must cut the cap of the cigar, forming the cap into a hollow shape so as to savor the taste and aroma of the cigar after the other end (i.e., the foot) of the cigar is lit.

Nowadays, a cigar cutter is typically used as the tool for cutting the cigar cap. While it is feasible for a cigar smoker to bite the cigar cap open directly with their teeth, doing so will not only fill the smoker's mouth with tobacco leaf pieces, but also make an irregular opening in the cap such that the evenness of burn, and consequently the smoothness of smoking and the taste and flavor, of the cigar are compromised during the smoking process. Only a cigar cutter can cut a proper, smooth opening in a cigar to bring out the flavor of the cigar to the fullest while preventing the wrapper of the cigar from being torn, which if happening will make the cigar surface visually unpleasant.

A common cigar cutter is briefly described below with reference to FIG. 1 and FIG. 2. The cigar cutter 1 includes a bottom casing 11, a top casing 13, a stationary handle 15, and a movable handle 17. The bottom casing 11 and the top casing 13 can be put together to form a housing 10 (as shown in FIG. 2), and are provided with corresponding through holes 110 and 130 respectively. The stationary handle 15 is provided at one end of the bottom casing 11 and is provided with a stationary blade 151. The stationary blade 151 can be received between the bottom casing 11 and the top casing 13 and has a cutting edge covering a portion of the through holes 110 and 130. The movable handle 17 is movably fitted into the opposite end of the bottom casing 11 and is provided with a movable blade 171. The movable handle 17 can be pulled or pushed by a user in order for the movable blade 171 to extend into or be moved out of the housing 10.

With continued reference to FIG. 1 and FIG. 2, the user can move the movable handle 17 in order to bring the cigar cutter 1 into either a closed state, i.e., a state in which the movable blade 171 completely covers the remaining portion of the through holes 110 and 130, or an open state, i.e., a state in which the movable blade 171 does not cover the remaining portion of the through holes 110 and 130 at all (as shown in FIG. 2). While the cigar cutter 1 is in the open state, the user can put the cap C of a cigar into the through holes 110 and 130 and then push the movable handle 17 in order to bring the cigar cutter 1 into the closed state and thereby cut a smooth opening in the cap C.

However, as the movable handle 17 does not have any positioning effect, changing the conventional cigar cutter 1 between the open state and the closed state depends entirely on the user's pulling or pushing the movable handle 17 manually. Such an operation method is evidently not convenient. Moreover, once the cigar cutter 1 is closed and in storage, a relatively strong collision may turn the cigar cutter 1 into the open state by accident. Should that happen, and if the user reaches for the cigar cutter 1 without noticing that it is in the open state, the user may put a finger into the through holes 110 and 130 inadvertently and thus suffer a cut in the finger by the movable blade 171. It is therefore an important issue to be addressed by developers and manufacturers in the cigar industry to improve the conventional cigar cutters so as to provide more convenient and safer user experience.

SUMMARY

In view of the astonishing purchasing power of cigar aficionados for cigar accessories, in which cigar cutters are undoubtedly indispensable everyday carry items, as a result of an extensive research and repeated experiments, the present disclosure provides a cigar cutter with a positioning mechanism for selectively keeping it in an open or closed state as disclosed herein. This cigar cutter is intended, among others, to be more useful, easier to operate, and safer than its prior art counterparts, and draw consumers' attention.

Certain aspects of the present disclosure are directed to a cigar cutter with a positioning mechanism keeping it in an open or closed state. The cigar cutter includes a main body, a rotatable ring, an elastic element, at least one cutting blade unit, and an arresting block. The main body is formed with a first through hole and provided therein with at least one guide track divided at least into a smooth groove, a direction-changing groove, and an abutting groove. One end of the direction-changing groove is in communication with an end of the smooth groove. The other end of the direction-changing groove is in communication with an end of the abutting groove. One side of the direction-changing groove has a shoulder. One side of the abutting groove that is opposite to the shoulder is formed with an abutting block. A portion of the abutting block corresponds to a space between two opposite sides of the smooth groove. The rotatable ring can be movably located in the main body, and is formed with at least one first position-limiting track and a second through hole that corresponds to the first through hole. The elastic element can be located in the main body, and has one end that can be fixed to a first positioning portion of the main body, and another end that be fixed to a second positioning portion of the rotatable ring. The at least one cutting blade unit can be movably mounted on the main body, has one side that can be exposed from the main body and the other side that can extend into the main body, and has a position-limiting post. The elastic element can be compressed when the cutting blade unit is displaced along a direction towards the main body, and push the cutting blade unit away from the main body and drive the rotatable ring to rotate reversely so that the cigar cutter enters an open state. The first position-limiting track allows the position-limiting post to extend and slide therein. The position-limiting post can: when the cutting blade unit is moved along the direction towards the main body, slide from a first end of the first position-limiting track towards a second end of the first position-limiting track and push the rotatable ring to rotate so as to compress the elastic element until the cigar cutter enters a closed state, with the cutting blade unit covering the first through hole and the second through hole in the closed state; and when the cutting blade unit is driven by the elastic element to move along a direction away from the main body, slide from the second end of the first position-limiting track towards the first end of the first position-limiting track through reverse rotation of the rotatable ring driven by the elastic element, so that the cutting blade units enters the open state, with the first through hole and the second through hole being not covered by the cutting blade unit in the open state. The arresting block has a first length between two first opposite sides of the arresting block that is equal to or less than a distance between the two opposite sides of the smooth groove, and a second length that is greater than the distance between the two opposite sides of the smooth groove and defined as a maximum distance between two second opposite sides of the arresting block that are other than the two first opposite sides. The arresting block can: be pivotally connected to the rotatable ring; extend into the guide track; move in the guide track in response to rotation of the rotatable ring; when the cigar cutter is in the open state, be located in the smooth groove with the two first opposite sides of the arresting block corresponding to the two opposite sides of the smooth groove, respectively; when the cutting blade unit is pressed and the elastic element is compressed, move from the smooth groove along a direction towards the abutting groove until touching the abutting block; rotate in a rotating direction in response to touching the abutting block; when the cutting blade unit is not pressed and the rotatable ring is driven to rotate reversely by a restoring force of the elastic element, move along a direction from the abutting groove towards the direction-changing groove until touching the shoulder; and in response to touching the shoulder, rotate in the rotating direction so that the two second opposite sides of the arresting block correspond to two opposite sides of the direction-changing groove respectively to keep the two second opposite sides of the arresting block from extending into the smooth groove and the cigar cutter in the closed state. Accordingly, a user needs only to press the at least one cutting blade unit to easily position the cigar cutter at a current state, such as an open state or a closed state, which effectively increases the storage safety for the user and endows the cigar cutter with better operability.

In certain embodiments, the arresting block can further: when the cigar cutter is in the closed state, the cutting blade unit is pressed and the elastic element is compressed, move along a direction from the direction-changing groove towards the abutting groove until touching the abutting block; rotate in the rotating direction in response to touching the abutting block; when the cutting blade unit is not pressed and the rotatable ring is driven to rotate reversely by the restoring force of the elastic element to push the cutting blade unit to move, move along the direction from the abutting groove towards the direction-changing groove until touching the shoulder; and in response to touching the shoulder, rotate in the rotating direction so that the two first opposite sides of the arresting block correspond to the two opposite sides of the direction-changing groove respectively and extend into the smooth groove and the cigar cutter enters the open state.

In certain embodiments, each of the two second opposite sides of the arresting block is inwardly formed with a recess.

In certain embodiments, the rotating direction is clockwise.

In certain embodiments, a longitudinal distance between the two opposite sides of the direction-changing groove is greater than a longitudinal distance between the two opposite sides of the smooth groove.

In certain embodiments, the main body includes a front cover formed with a front through hole and a rear cover formed with a rear through hole, and the front through hole and the rear through hole jointly form the first through hole.

In certain embodiments, the guide track has an arcuate shape.

In certain embodiments, the cigar cutter further has a positioning ring that can be located in the main body, and is formed with a third through hole and at least one second position-limiting track. The third through hole corresponds to the first through hole, and the position-limiting post can: extend into, and slide in, the first position-limiting track and the second position-limiting track; when the cutting blade unit is moved along the direction towards the main body, slide from a first end of the second position-limiting track towards a second end of the second position-limiting track and push the rotatable ring to rotate until the cigar cutter enters the closed state, with the cutting blade unit covering the first through hole, the second through hole and the third through hole in the closed state; and when the elastic element drives the rotatable ring to rotate reversely, slide from the second end of the second position-limiting track towards the first end of the second position-limiting track, so that the cutting blade units enters the open state, with the first through hole, the second through hole and the third through hole being not covered by the cutting blade unit in the open state.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION

Figure 1:
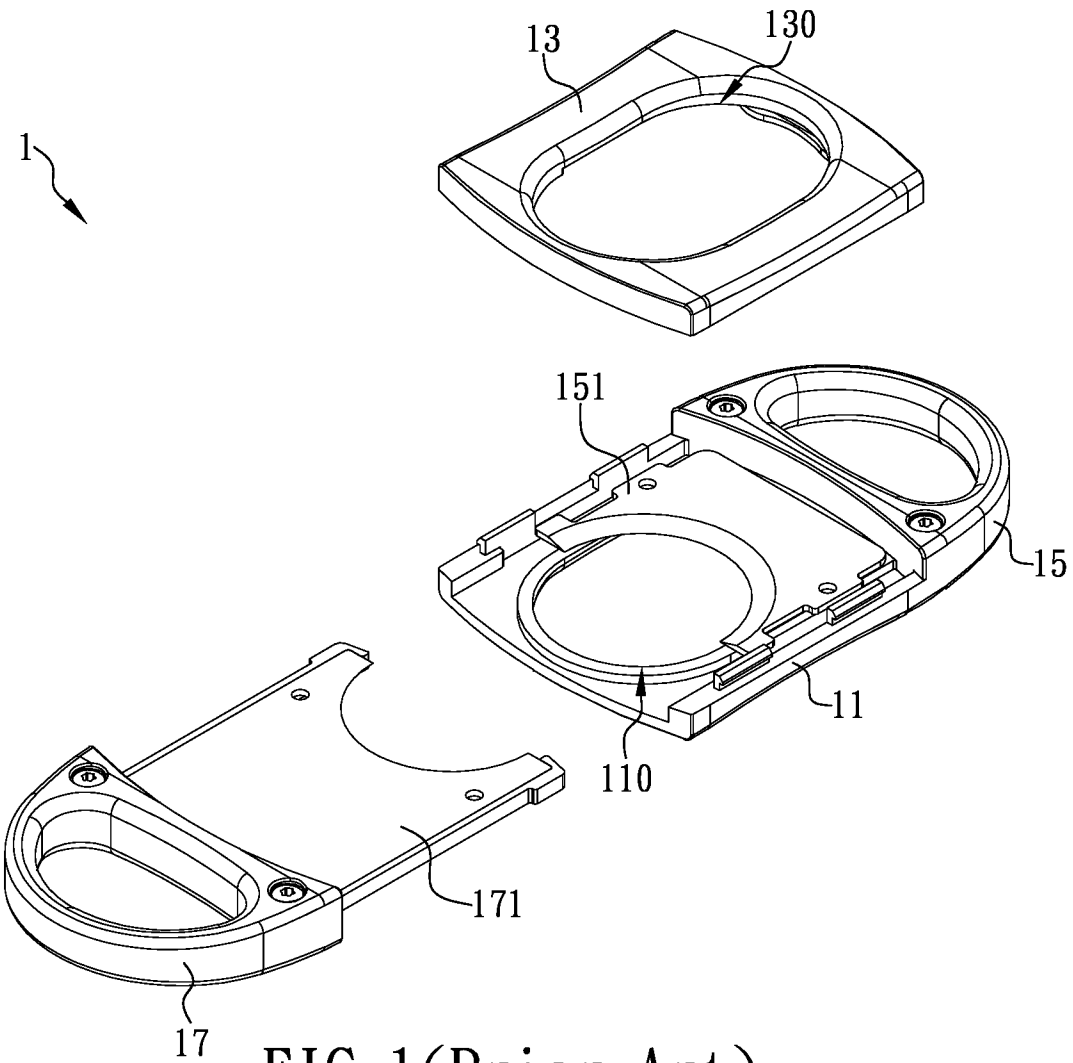
FIG. 1(Prior Art)
FIG. 1 is an exploded view of a conventional cigar cutter.
Figure 2:
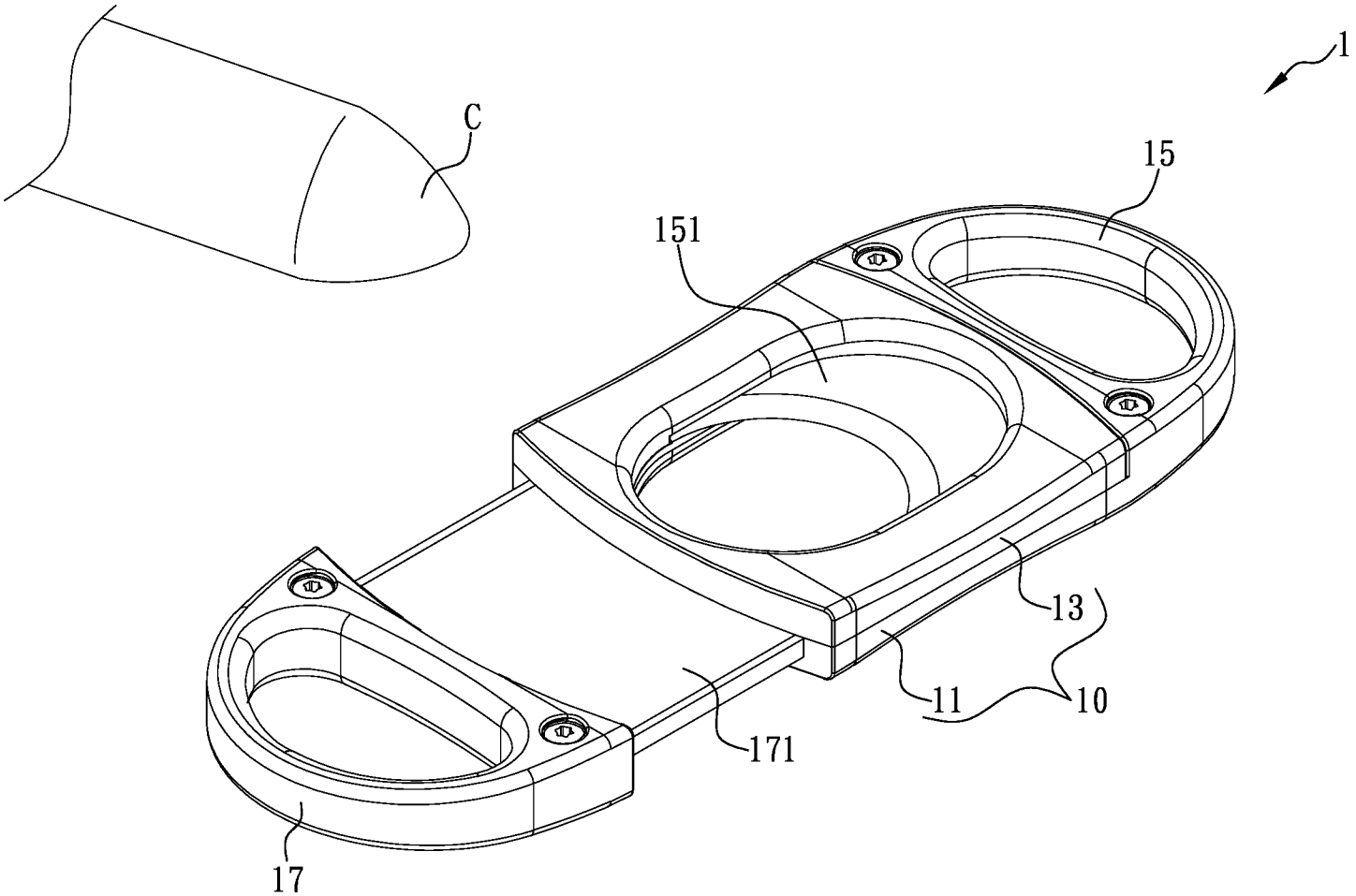
FIG. 2(Prior Art)
FIG. 2 is an assembled view of the conventional cigar cutter.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The accompanying drawings are schematic and may not have been drawn to scale. The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, materials, objects, or the like, which are for distinguishing one component/material/object from another one only, and are not intended to, nor should be construed to impose any substantive limitations on the components, materials, objects, or the like. Directional terms (e.g., "front", "rear", "left", "right", "upper/top" and/or "lower/bottom") are explanatory only and are not intended to be restrictive of the scope of the present disclosure.

Figure 3:
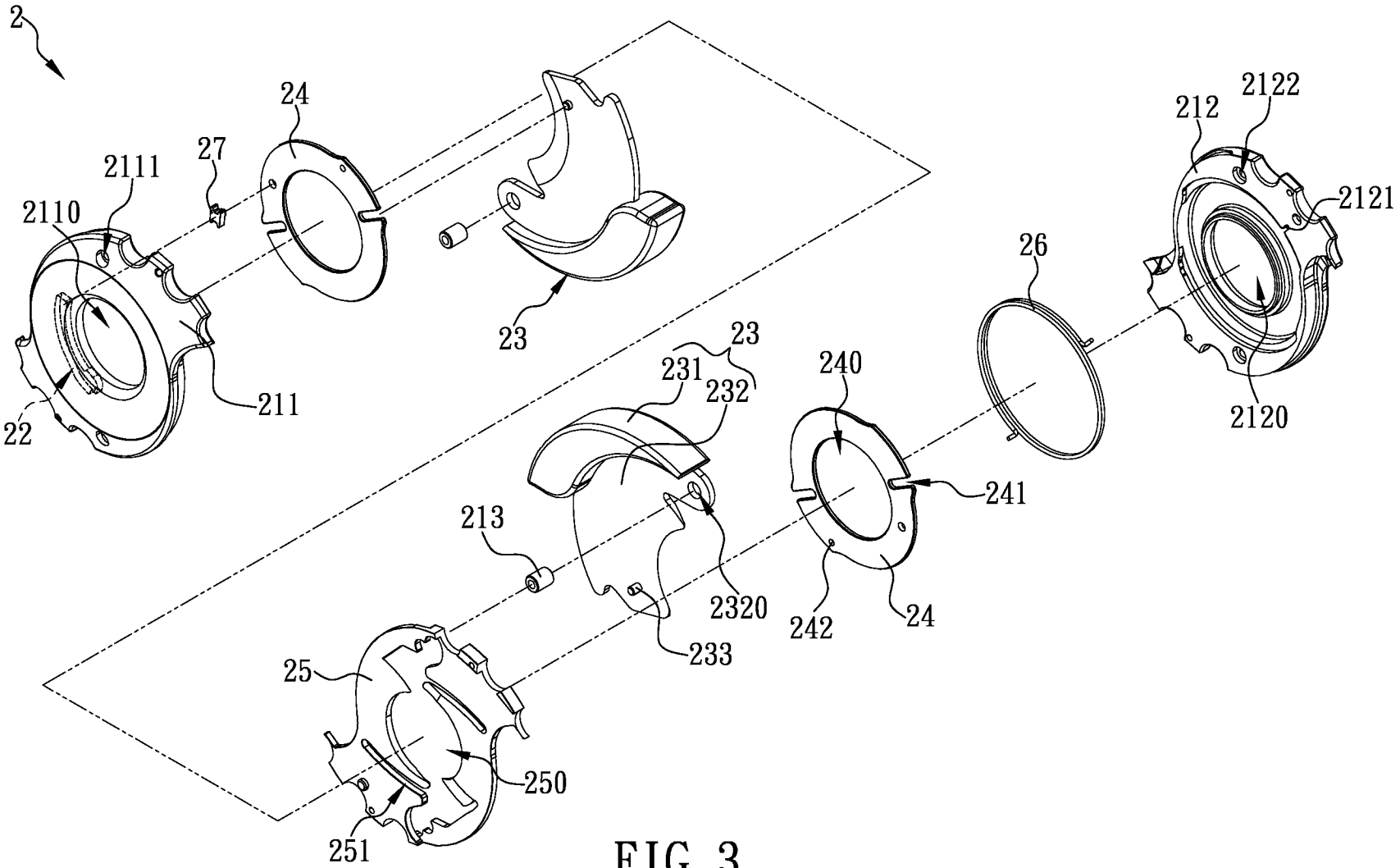
FIG. 3 is an exploded view of a cigar cutter according to certain embodiments of the present disclosure.
Figure 4:
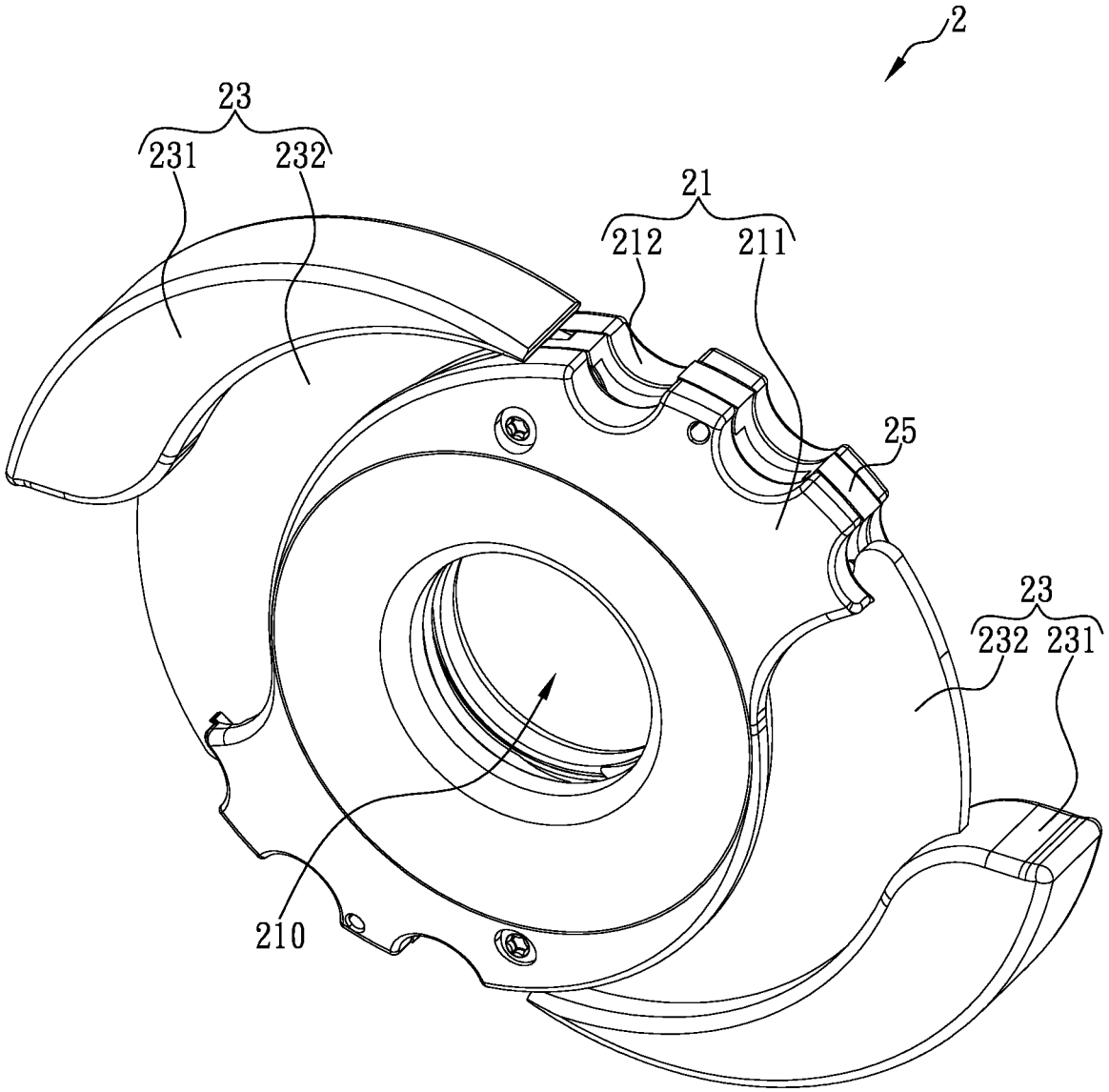
FIG. 4 is a schematic diagram of a cigar cutter in an open state according to certain embodiments of the present disclosure.
Figure 5:
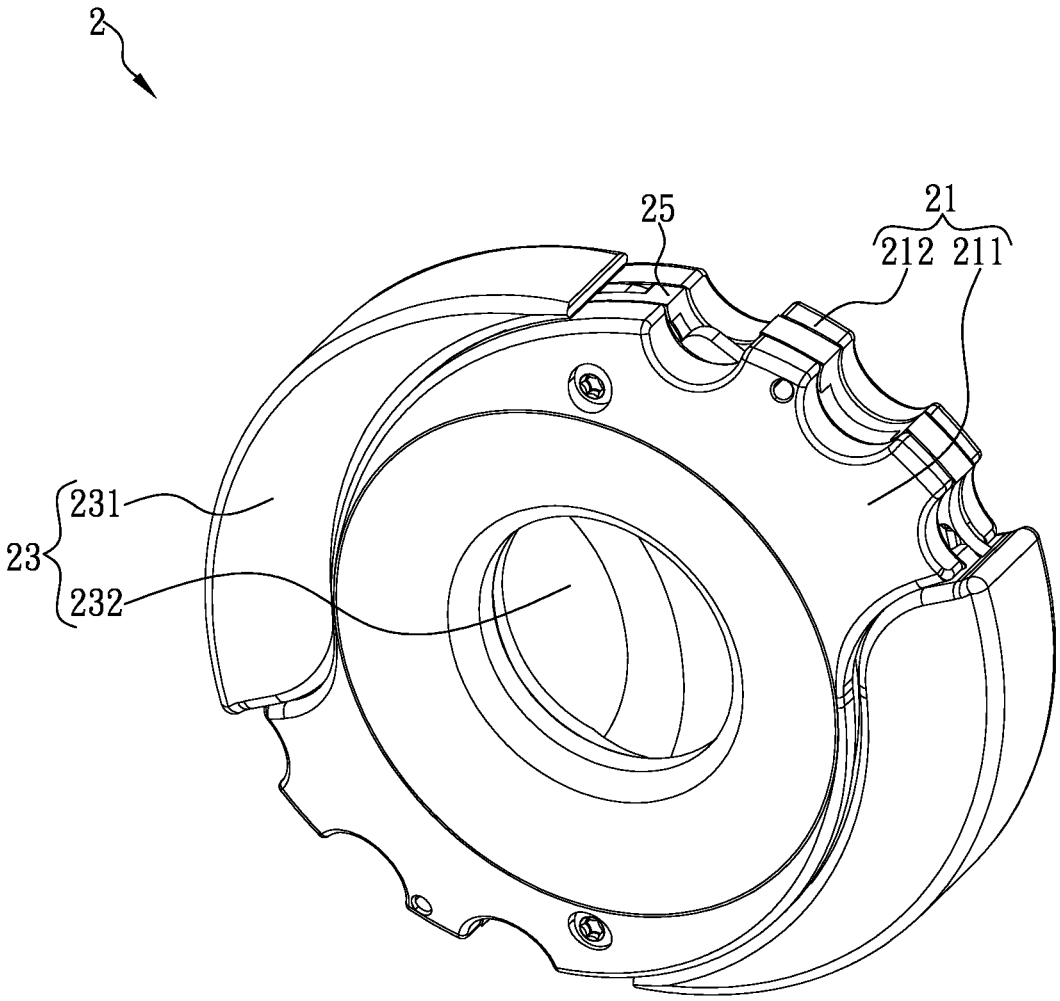
FIG. 5 is a schematic diagram of a cigar cutter in a closed state according to certain embodiments of the present disclosure.

The present disclosure provides a cigar cutter that has a positioning mechanism for selectively keeping the cigar cutter in an open or closed state. Referring to FIG. 3 to FIG. 5, in certain embodiments, the cigar cutter 2 includes a main body 21, at least one cutting blade unit 23, a rotatable ring 24, a positioning ring 25, an elastic element 26, and an arresting block 27. To facilitate description, the front side of a component is defined as the side facing the lower left corner of FIG. 3, and the rear side as facing the upper right corner of FIG. 3. The main body 21 is formed with a first through hole 210, and the first through hole 210 is open on the front and rear sides of the main body 21. In certain embodiments, the cigar cutter 2 has one first through hole 210. However, the present disclosure is not limited thereto, and in certain embodiments, the number, shape, location and/or size of the through hole(s) 210 can be adjusted by a manufacturer according to product requirements, for example, for cutting a substantially V-shaped groove in a cigar or clipping off (cutting off) the cigar cap directly.

Figure 6:
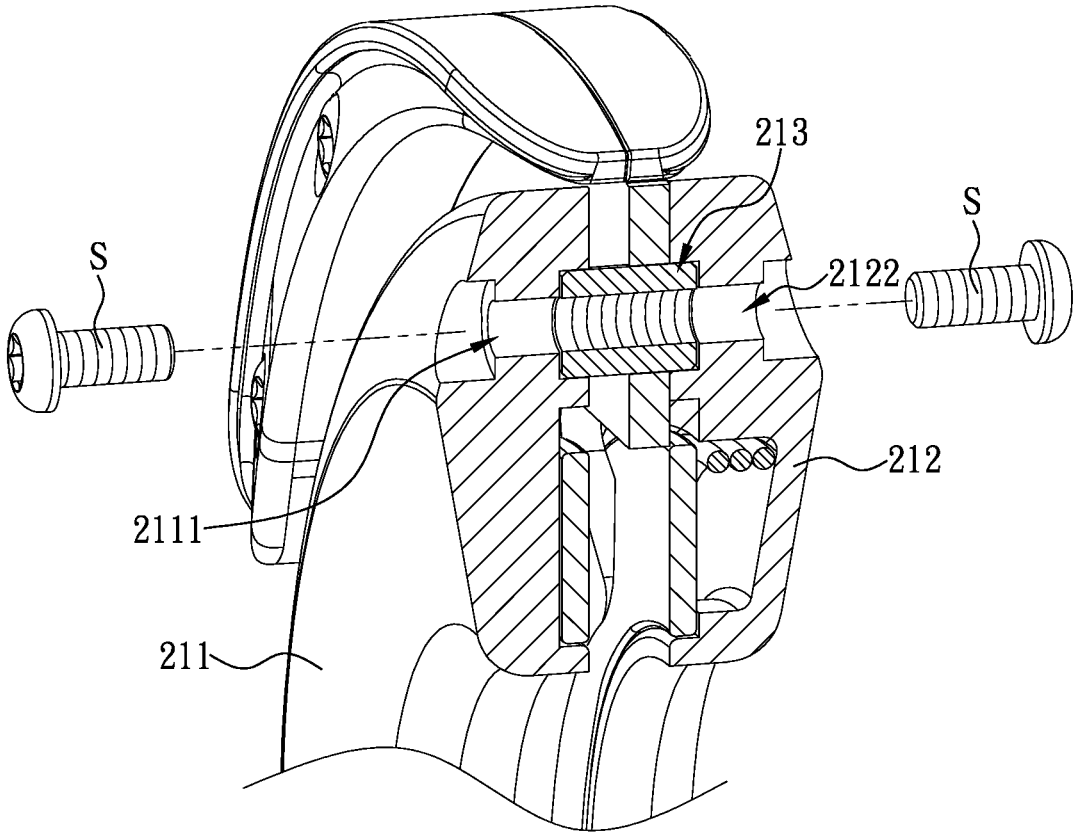
FIG. 6 is a schematic diagram of the assembly relationship between a front cover, a rear cover, a pillar and a fixing element according to certain embodiments of the present disclosure.

In certain embodiments, with continued reference to FIG. 3 to FIG. 5, the main body 21 includes a front cover 211 and a rear cover 212. The rear cover 212 has a first positioning portion 2121 (e.g., a slit) and is formed with at least one rear through hole 2120. The front cover 211 has at least one front through hole 2110. When the front cover 211 and the rear cover 212 are put together to form the main body 21, the front through hole 2110 and the rear through hole 2120 are in communication with each other and jointly form the first through hole 210. In other words, a user can put a cigar through the corresponding front and rear through holes 2110 and 2120 in this state. In certain embodiments, the front cover 211 is formed with at least one front assembly hole 2111, the rear cover 212 is formed with at least one rear assembly hole 2122, and at least one post 213 is configured to be disposed between the corresponding front and rear assembly holes 2111 and 2122 (as shown in FIG. 6) so that at least one fixing element S (e.g., a screw) can be locked into the post 213 through one of the corresponding front and rear assembly holes 2111 and 2122, thereby connecting the front cover 211 and the rear cover 212 together. However, the present disclosure is not limited thereto, and in certain embodiments, the structure, appearance, and/or the number of components, of the main body 21 can be adjusted by a manufacturer according to product requirements, and the main body 21 can include more or less than two components (for example, more or less than components including the front cover 211 and the rear cover 212).

Figure 7:
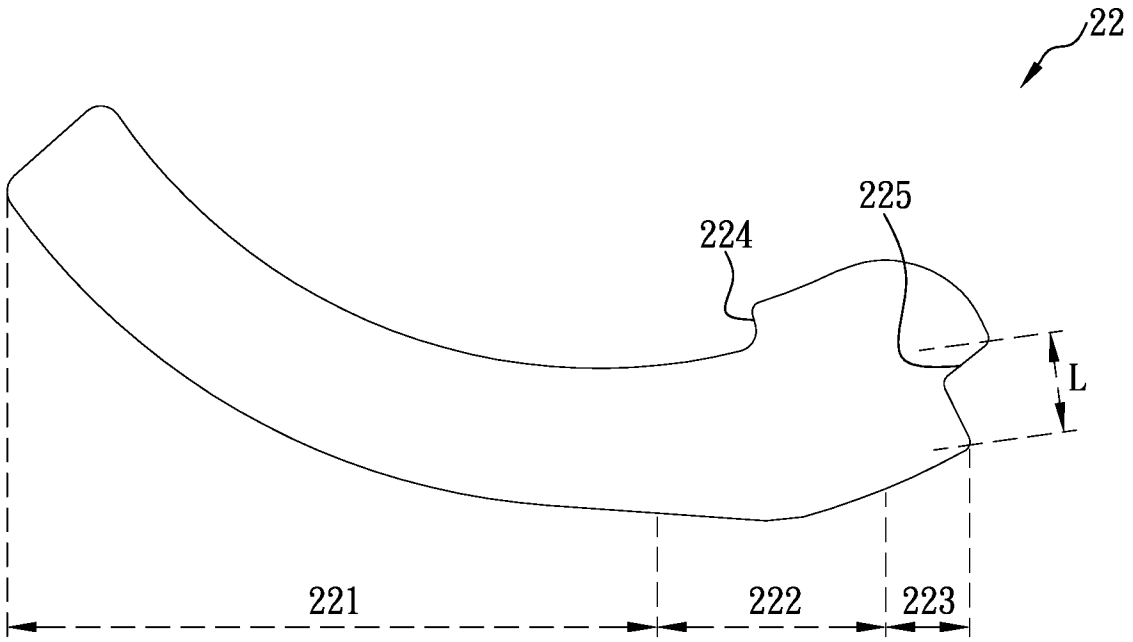
FIG. 7 is a schematic diagram of a guide track according to certain embodiments of the present disclosure.

In certain embodiments, referring to FIG. 3 and FIG. 7, the front cover 211 is formed therein with at least one guide track 22. The guide track 22 has an arcuate shape (but is not necessarily so shaped) and is divided at least into a smooth groove 221, a direction-changing groove 222, and an abutting groove 223. The distance between the two opposite sides (e.g., the upper and lower long sides shown in FIG. 7) of the smooth groove 221 is uniform or substantially uniform. One end of the direction-changing groove 222 is in communication with the corresponding end of the smooth groove 221, and the other end of the direction-changing groove 222 is in communication with the corresponding end of the abutting groove 223. One side of the direction-changing groove 222 has a shoulder 224. When viewed from the viewing angle of FIG. 7, a part of the upper inner wall surface of the direction-changing groove 222 that is to the right of the shoulder 224 is closer to the top edge of the drawing than a part of the upper inner wall surface of the direction-changing groove 222 that is to the left of the shoulder 224 is, and the lower inner wall surface of the direction-changing groove 222 is closer to the bottom edge of the drawing than the lower inner wall surface of the smooth groove 221 is. Moreover, the side of the abutting groove 223 that is opposite to the shoulder 224 (e.g., the lower side of the abutting groove 223 as shown in FIG. 7) is formed with an abutting block 225. A portion of the abutting block 225 corresponds to a space between the two opposite sides of the smooth groove 221; in other words, an extension line L projected from a wall surface portion of the abutting block 225 will lie between the upper and lower sides of the smooth groove 221 as shown in FIG. 7.

Referring to FIG. 3 and FIG. 4, in which the cigar cutter 2 is shown as having two cutting blade units 23, each cutting blade unit 23 can be movably mounted on the main body 21 and includes a blade holder 231 and a blade 232. One side of each cutting blade unit 23 (e.g., the blade holder 231) is configured to be exposed from the main body 21. The other side of each cutting blade unit 23 (e.g., the blade 232) is configured to extend into the main body 21. Each cutting blade unit 23 further includes a position-limiting post 233 (e.g., on the blade 232). In certain embodiments, at least one position-limiting post 233 is disposed on a corresponding blade 232 at a position adjacent to one side of the corresponding blade 232, and at least one through hole 2320 is formed at the blade 232 at a position adjacent to the opposite side of the blade 232. The through hole 2320 is configured to allow passage of the post 213, and the blade 232 forms a pivotal connection relationship with the corresponding post 213 such that the corresponding cutting blade unit 23 can be mounted movably on the main body 21 and can be rotated about an axis defined by the corresponding post 213. In certain embodiments, the cigar cutter 2 includes two structurally identical cutting blade units 23 but is not necessarily so configured. In certain embodiments, the main body 21 can be directly provided therein with a stationary cutting blade unit, with the stationary cutting blade unit corresponding in position to the blade 232 of a cutting blade unit 23 so that the cutting blade unit 23 is moved toward the stationary cutting blade unit when moved inward of the main body 21.

Referring to FIG. 3, which shows two identical rotatable rings 24 by way of example only, each rotatable ring 24 can be located in the main body 21 movably, is configured to rotate about a central axis of itself with respect to the main body 21, and is formed with a second through hole 240 and at least one first position-limiting track 241. The second through hole 240 corresponds to the first through hole 210, and the position-limiting post 233 of each cutting blade unit 23 matches the corresponding first position-limiting track 241 so as to be slidable in the corresponding first position-limiting track 241. The positioning ring 25 is fixed in the main body 21, does not rotate with respect to the main body 21, is formed with a third through hole 250 corresponding to the first through hole 210, and is formed with at least one second position-limiting track 251. The position-limiting post 233 of each cutting blade unit 23 matches the corresponding second position-limiting track 251 so as to be slidable in the corresponding second position-limiting track 251. In certain embodiments, the positioning ring 25 forms at least one passage-allowing space corresponding in position to the at least one post 213 so that the at least one post 213 can pass through, and be exposed from the two opposite sides of, the positioning ring 25. The position-limiting post 233 of each cutting blade unit 23 is configured to extend into, and slide in, the corresponding first position-limiting track 241 and the corresponding second position-limiting track 251. When a position-limiting post 233 is moved, as the positioning ring 25 is fixed in the main body 21, the position-limiting post 233 can only be moved in and along the corresponding second position-limiting track 251. Since the rotatable ring 24 is movably located in the main body 21, the position-limiting post 233 can push the inner wall of the corresponding first position-limiting track 241 when moving in and along the corresponding first position-limiting track 241, such as to drive the rotatable ring 24 to rotate about the central axis of itself with respect to the main body 21.

Figure 8:
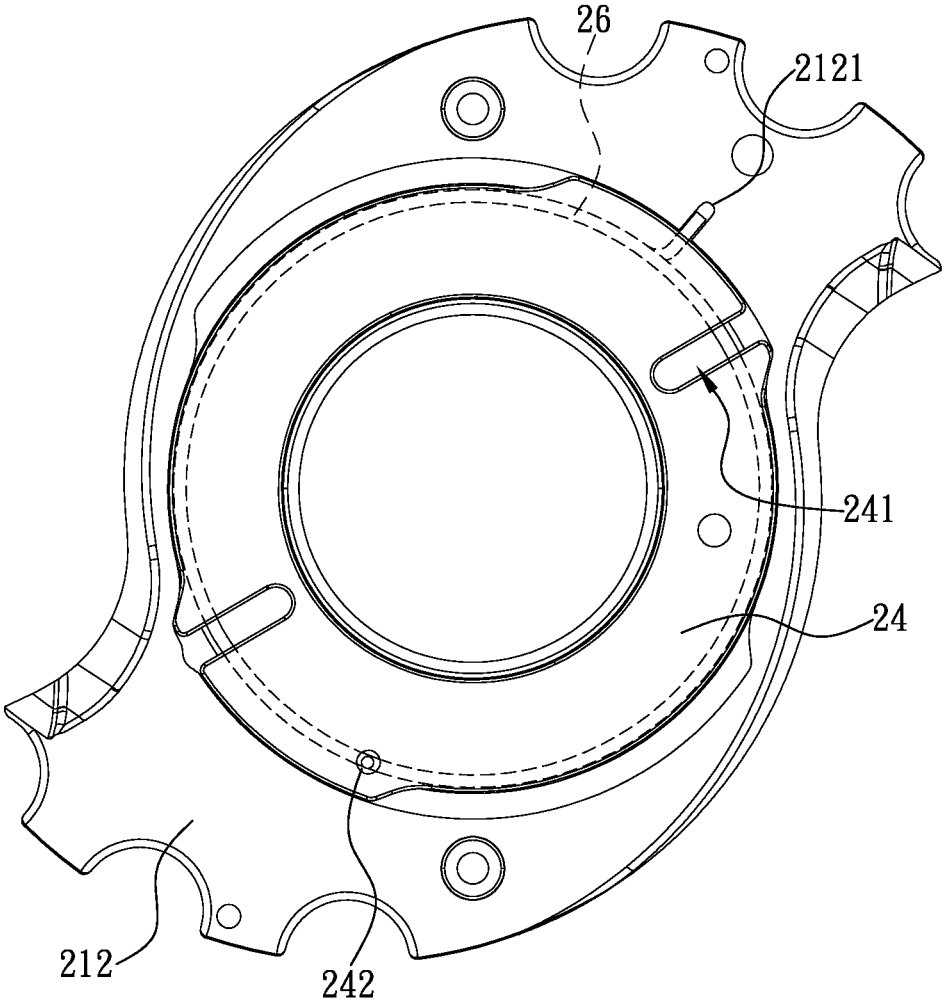
FIG. 8 is a schematic diagram of the assembly of an elastic element with a main body and a rotatable ring according to certain embodiments of the present disclosure.

Referring to FIG. 3 and FIG. 8, the elastic element 26 (for example, a volute spring, a torsion spring, etc.) can be located in the main body 21, has one end (hereinafter referred to as the first end) configured to be fixed to the first positioning portion 2121 of the main body 21. For example, the first end of the elastic element 26 can extend into and be engaged in the first positioning portion 2121 (e.g., a slit). The other end (hereinafter referred to as the second end) of the elastic element 26 can be fixed to a second positioning portion 242 (e.g., an aperture) of the rotatable ring 24. For example, the second end of the elastic element 26 can extend into the aperture. However, the present disclosure is not limited thereto, and in certain embodiments, the first positioning portion 2121, the second positioning portion 242, and the two ends of the elastic element 26 can be adjusted in configuration as long as the foregoing connection relationships can be formed. When the cigar cutter 2 includes two rotatable rings 24, the second end of the elastic element 26 can be fixed to the second positioning portion 242 of only one of the rotatable rings 24.

Figure 9:
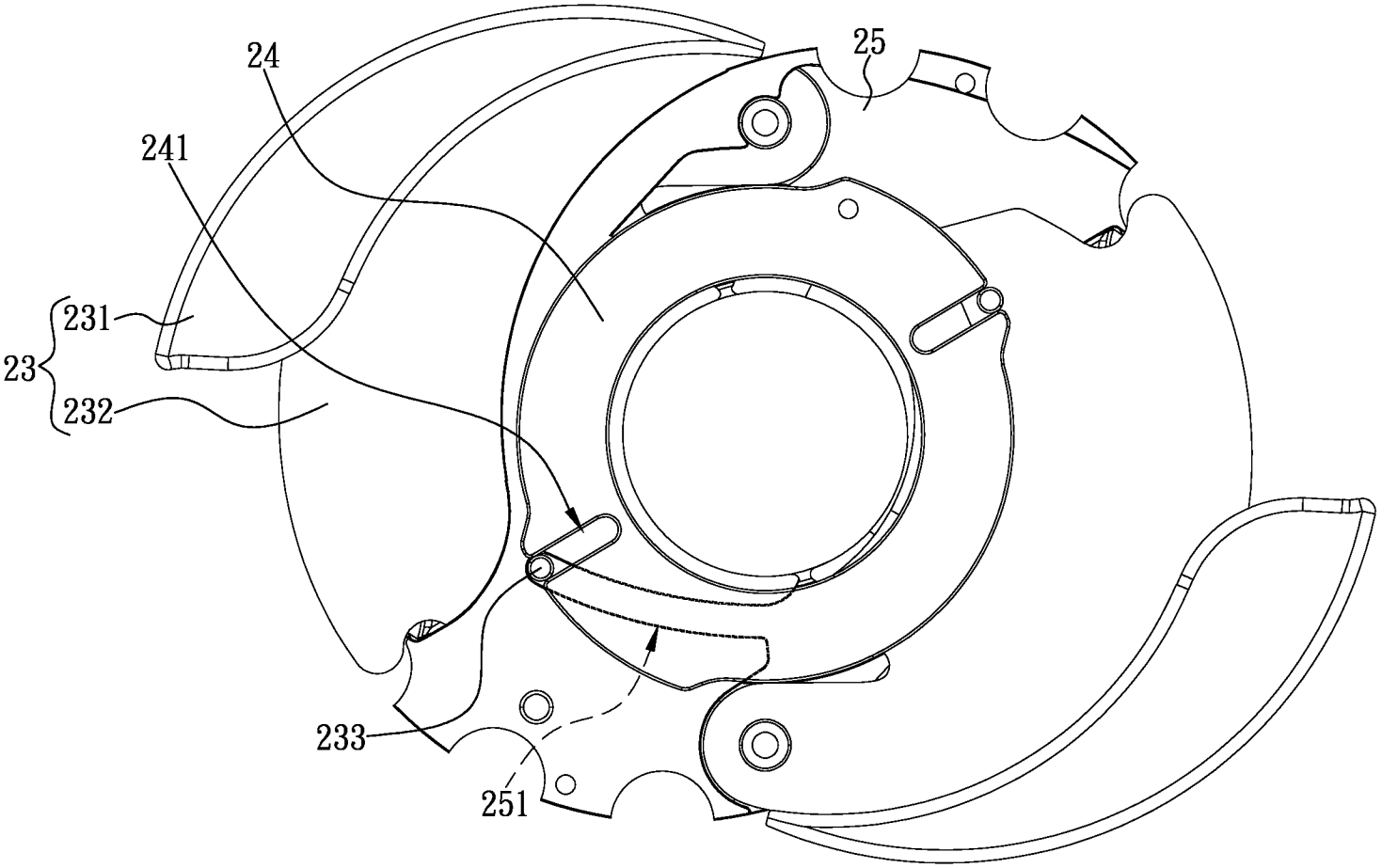
FIG. 9 is a schematic diagram of a position-limiting post being located at a first end of a first position-limiting track and a first end of a second position-limiting track according to certain embodiments of the present disclosure.

In certain embodiments, referring to FIG. 3. FIG. 5 and FIG. 8, when at least one cutting blade unit 23 is pressed by a user and thus displaced inward of the main body 21, the position-limiting post 233 slides from a first end of the corresponding first position-limiting track 241 (see FIG. 9) toward a second end of the corresponding first position-limiting track 241 (see FIG. 10) and from a first end of the corresponding second position-limiting track 251 (see FIG. 9) toward a second end of the corresponding second position-limiting track 251 (see FIG. 10), and pushes the rotatable ring 24 to rotate. During this rotating process, the rotatable ring 24 simultaneously drives the elastic element 26 such that the elastic element 26 is compressed and stores a restoring force to the extent that the cutting blade units 23 cover the first through hole 210, the second through hole 240, and the third through hole 250, i.e., until the cigar cutter 2 enters the closed state (see FIG. 5). When the cutting blade units 23 are no longer pressed, the restoring force of the elastic element 26 drives the rotatable ring 24 to rotate reversely. During the reverse rotation, the rotatable ring 24 pushes each position-limiting post 233 such that each position-limiting post 233 slides from the second ends (see FIG. 10) toward the first ends (see FIG. 9) of the corresponding first position-limiting track 241 and second position-limiting track 251 until the cutting blade units 23 no longer cover the first through hole 210, the second through hole 240, or the third through hole 250, i.e., until the cigar cutter 2 enters into the open state (see FIG. 4). It is noted that the reference of "the cutting blade units 23 cover the first through hole 210, the second through hole 240, and the third through hole 250" supra is defined as at least a portion of a cigar being unable to pass through any of the first through hole 210, the second through hole 240 and the third through hole 250, and accordingly the cutting blade units 23 being unable to cut the cigar or cut a groove in the cigar; and the reference of "the cutting blade units 23 no longer cover the first through hole 210, the second through hole 240, or the third through hole 250" supra is defined as the first through hole 210, the second through hole 240, and the third through hole 250 being in a state allowing passage of at least a portion of a cigar, and accordingly the cutting blade units 23 being able to cut the cigar or cut a groove in the cigar. In other words, the cigar cutter 2 cannot be used to cut a cigar when in the closed state, and can be used to cut a cigar when in the open state.

Figure 11:
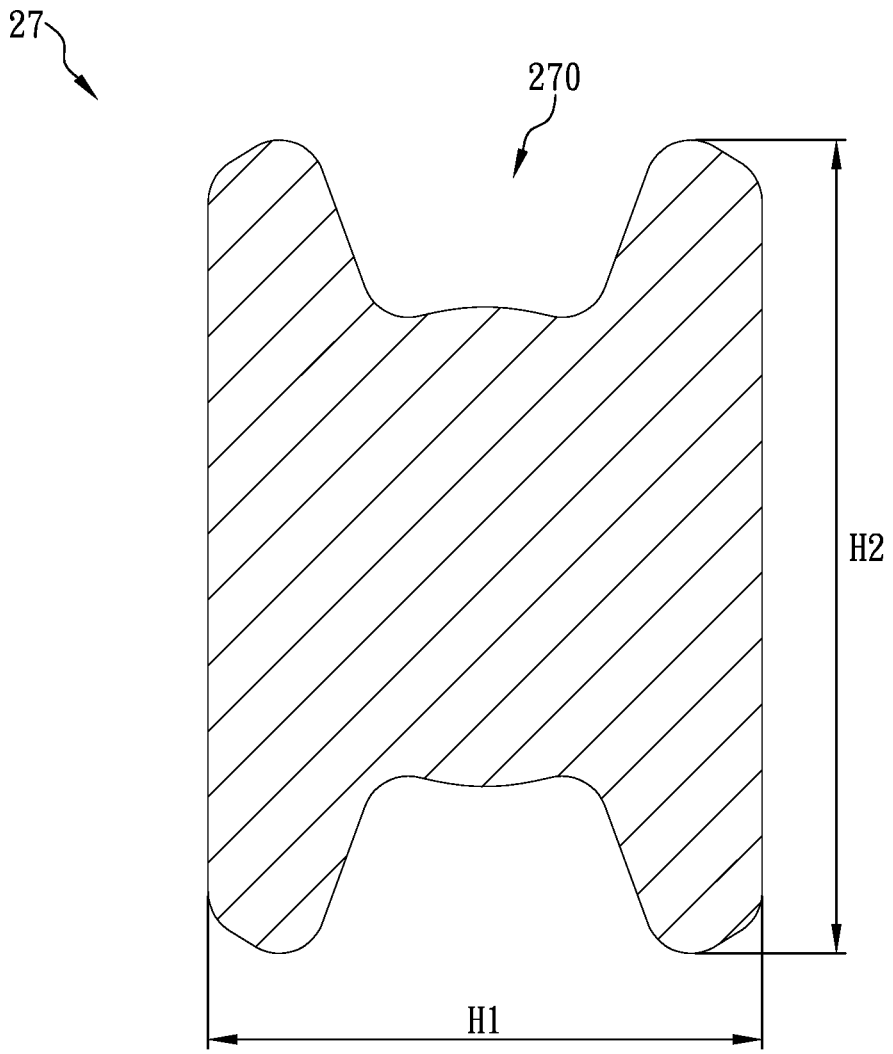
FIG. 11 is a cross-sectional view of an arresting block according to certain embodiments of the present disclosure.
Figure 12:
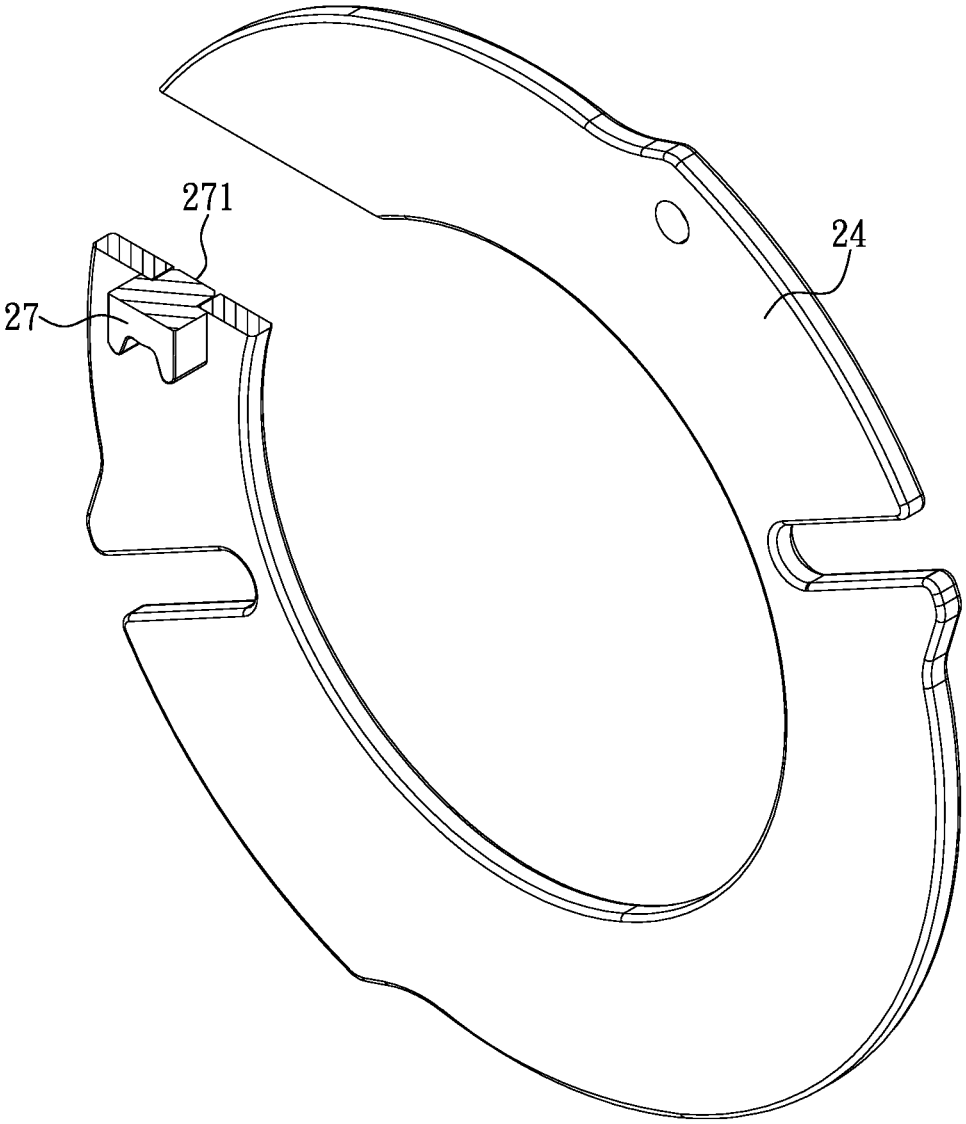
FIG. 12 is a schematic diagram showing a partial cross-section of the arresting block and of the rotatable ring according to certain embodiments of the present disclosure.

Referring to FIG. 3, FIG. 11, and FIG. 12, the arresting block 27 can be pivotally connected to the rotatable ring 24, extend into the guide track 22, and rotate about a central axis of itself when subjected to an external force or the interference of an external object. As shown in FIG. 12, the arresting block 27 can be protrudingly formed with a pivotal connection rod 271, and the pivotal connection rod 271 is configured to extend into, and be rotatable in, a hole of the rotatable ring 24. Once the rotatable ring 24 is mounted to the main body 21, the arresting block 27 can extend into the guide track 22 and can be moved in the guide track 22 in response to rotation of the rotatable ring 24. The arresting block 27 has a first length H1 (see FIG. 1I) defined as the distance between two opposite sides (hereinafter referred to as the two first opposite sides) of the arresting block 27, and the first length H1 is equal to or less than the distance between the two opposite sides (e.g., the upper and lower sides shown in FIG. 7) of the smooth groove 221. The arresting block 27 further has a second length H2 (see FIG. 11) defined as the maximum distance between two other opposite sides (hereinafter referred to as the two second opposite sides) of the arresting block 27, and the second length H2 is greater than the distance between the two opposite sides (e.g., the upper and lower sides shown in FIG. 7) of the smooth groove 221. In addition, to allow the arresting block 27 to better rotate and to have a lower chance of being stuck in the process described infra, in certain embodiments, each of the two second opposite sides can be inwardly formed with a recess 270. However, the present disclosure is not limited thereto.

Figure 13A:
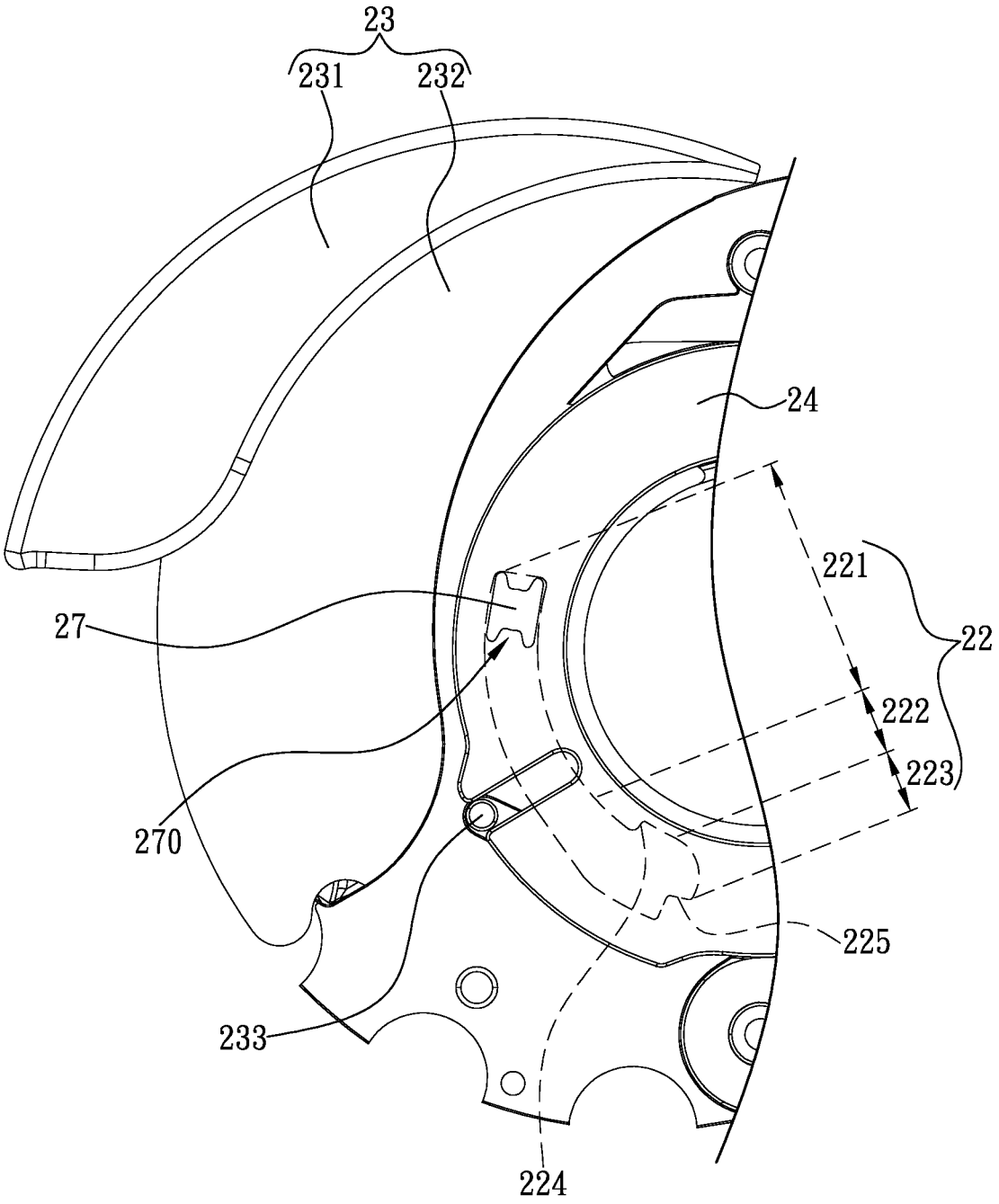
FIGS. 13A-13E are schematic diagrams showing the process of an arresting block being moved in a guide track when a cigar cutter enters into a closed state from an open state according to certain embodiments of the present disclosure.
Figure 13B:
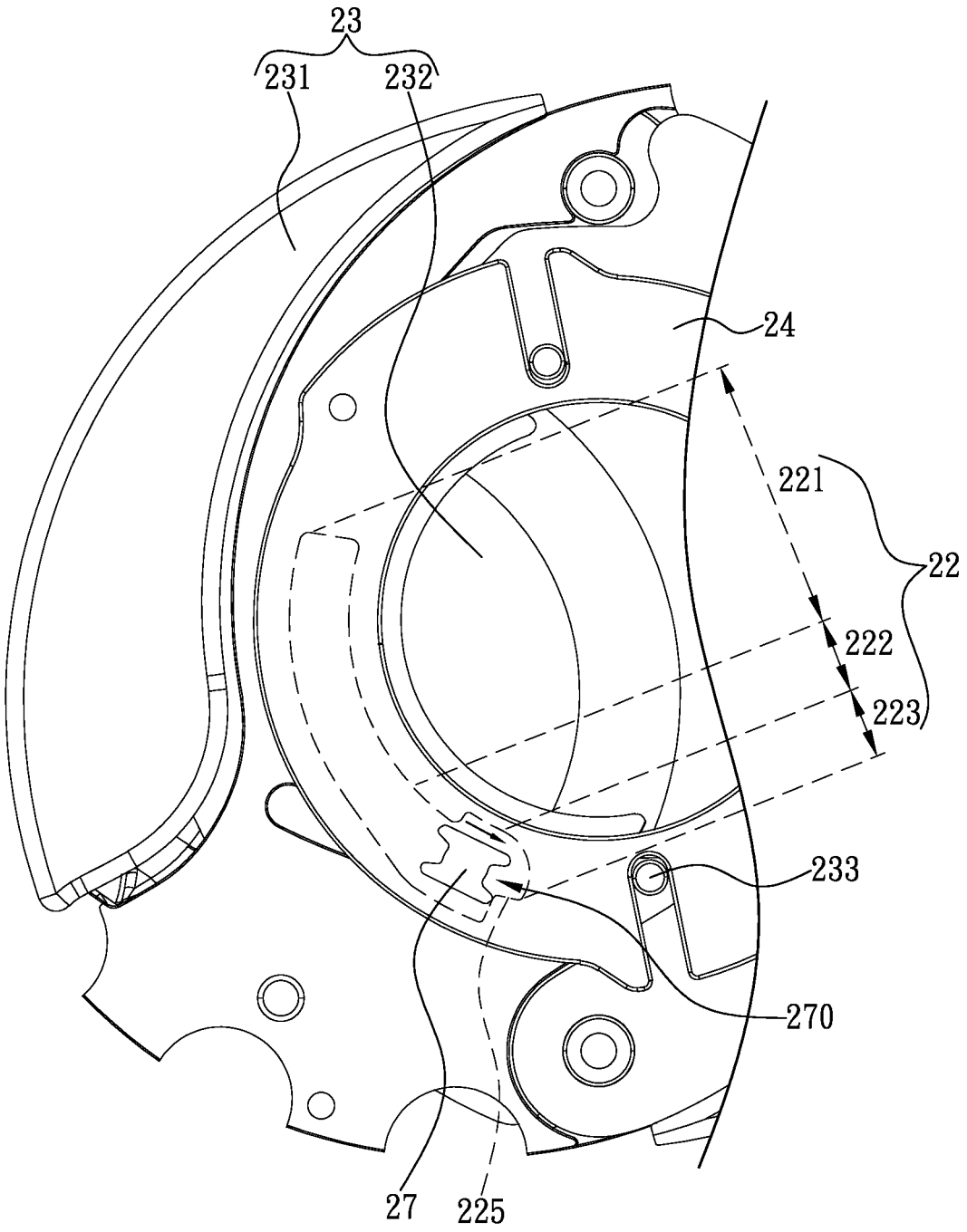
Figure 13C:
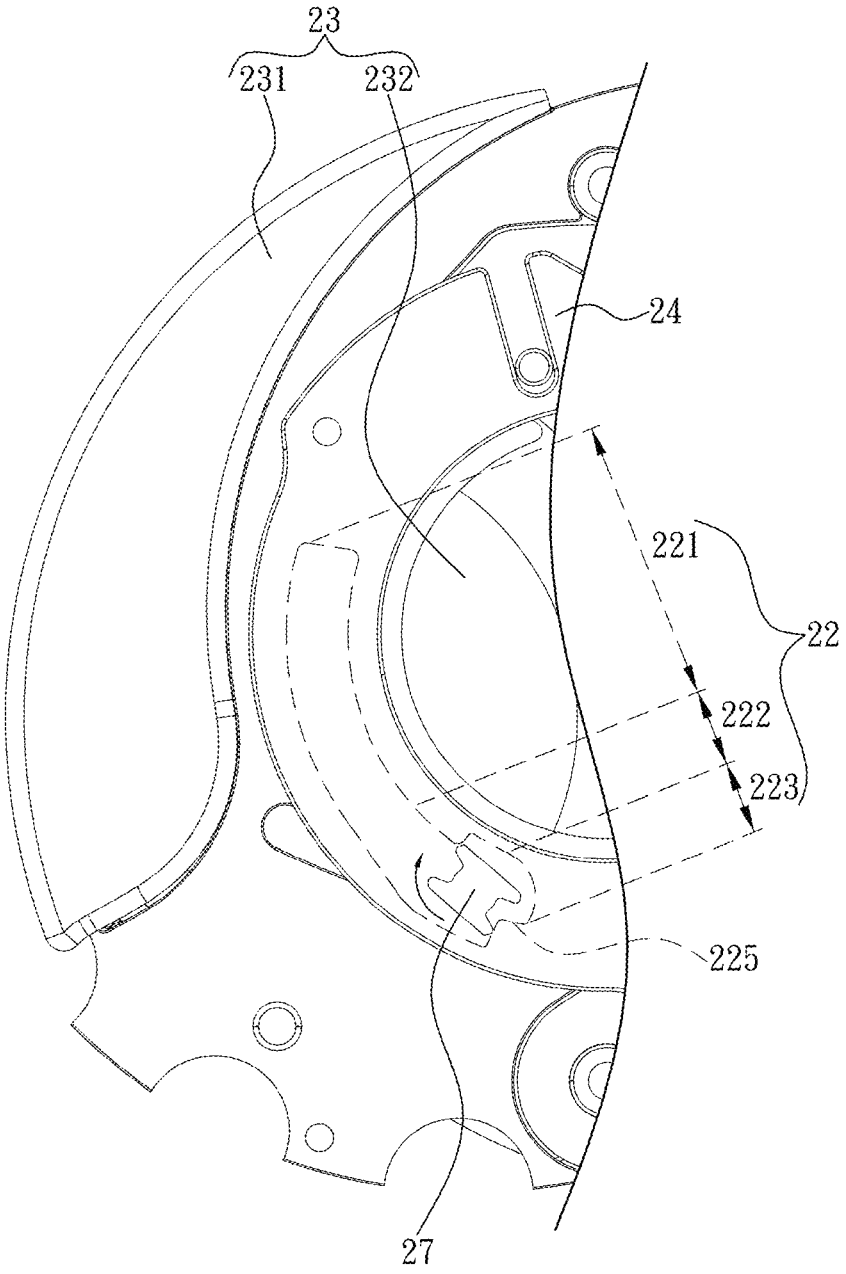

The process of the arresting block 27 being moved in the guide track 22 and the cigar cutter 2 being kept in the closed state is detailed as follows. Referring to FIG. 13A, when the cigar cutter 2 is in the open state, the arresting block 27 is in the smooth groove 221, with the two first opposite sides of the arresting block 27 corresponding to the two opposite sides of the smooth groove 221 respectively, and the cutting blade units 23 have been moved outward by the force the elastic element 26 applies to the rotatable ring 24 (see FIG. 4). When the blade holders 231 of the cutting blade units 23 are subsequently pressed by the user, the cutting blade units 23 are moved inward, and the position-limiting posts 233 on the cutting blade units 23 push the rotatable ring 24 to rotate and thereby compress the elastic element 26, and the arresting block 27 is moved from the smooth groove 221 along a direction toward the abutting groove 223, as shown in FIG. 13B. After moving from the smooth groove 221 through the direction-changing groove 222 into the abutting groove 223, the arresting block 27 touches, and is thus obstructed by, the abutting block 225 and therefore begins to rotate in a rotating direction (e.g., clockwise). In certain embodiments, as shown in FIG. 13C, a portion of the abutting block 225 extends into the corresponding recess 270 in order for the arresting block 27 to be rotated in the rotating direction.

Figure 13D:
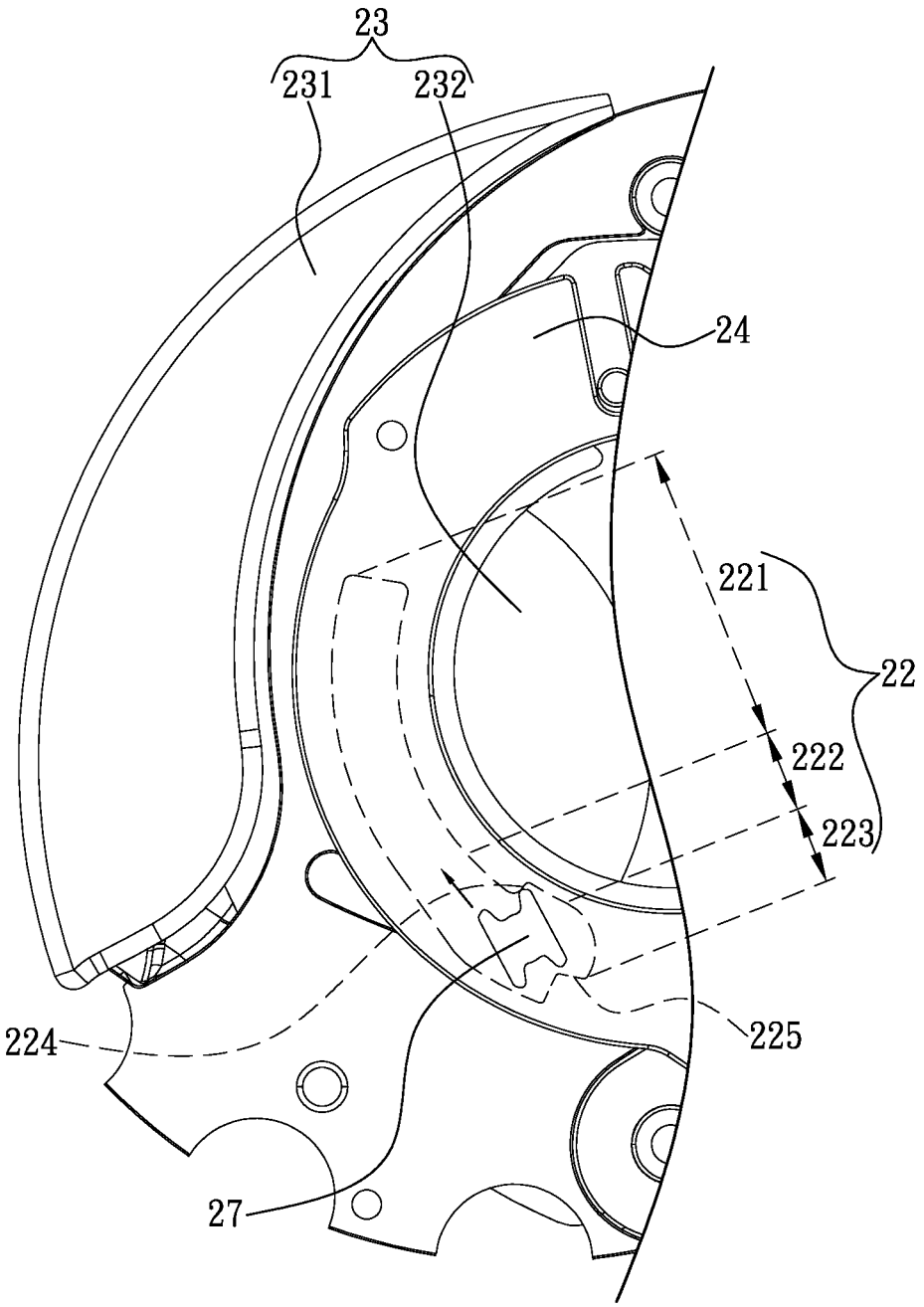
Figure 13E:
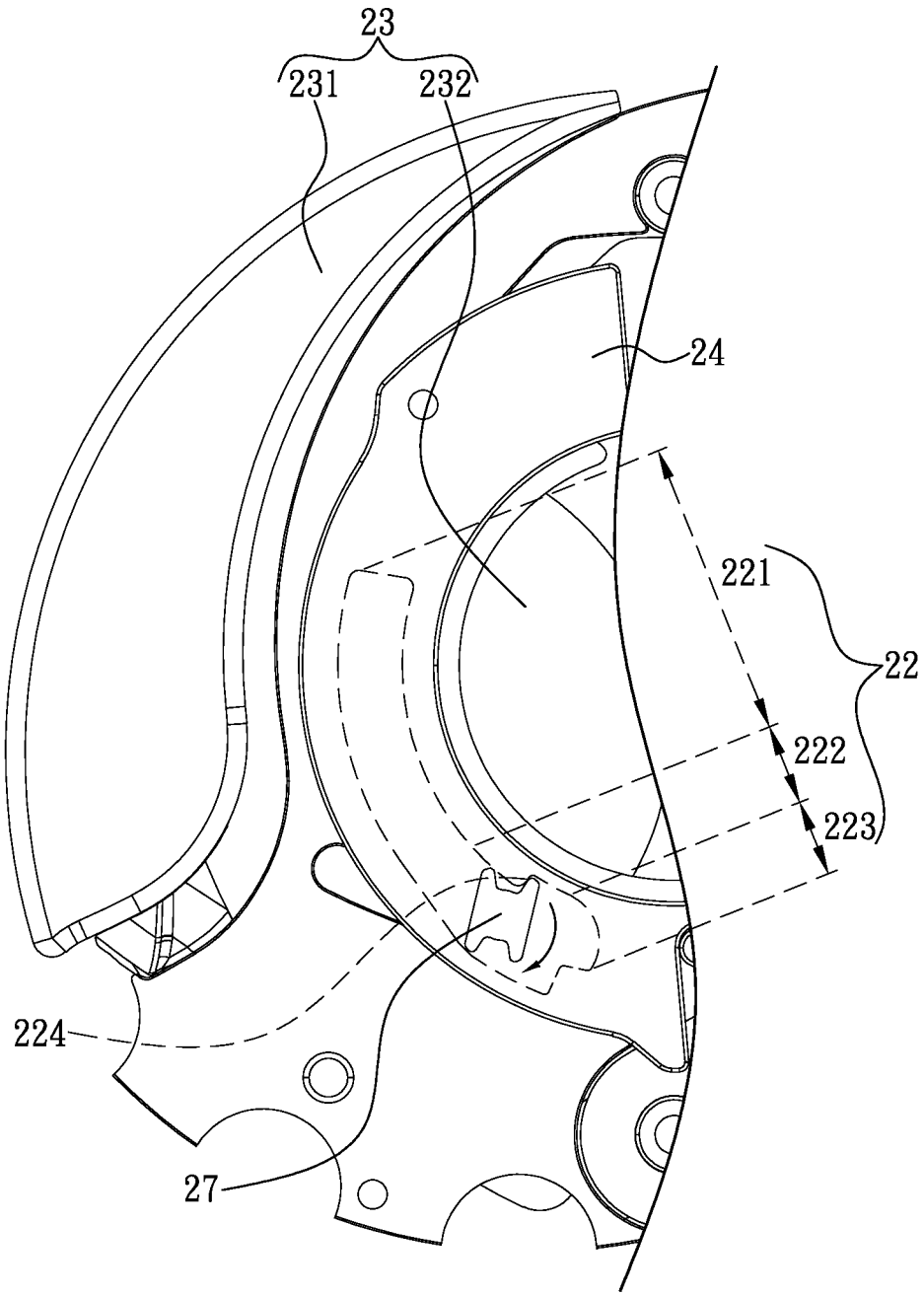

When the arresting block 27 touches the abutting block 225, referring to FIG. 3 and FIG. 5, the blades 232 of the cutting blade units 23 have covered the first through hole 210, the second through hole 240, and the third through hole 250. When the user releases fingers such that the cutting blade units 23 are no longer pressed, the rotatable ring 24 is driven to rotate reversely by the restoring force of the elastic element 26 and thereby pushes the cutting blade units 23 outward. During this process, the arresting block 27 is moved from the abutting groove 223 toward the direction-changing groove 222 (as shown in FIG. 13D) and thus separates from the abutting block 225. As the arresting block 27 has been rotated (for the first time) after touching the abutting block 225, the arresting block 27 is now moved toward the direction-changing groove 222 in an inclined position (with respect to the position of the arresting block 27 in FIG. 13A). The arresting block 27 will touch, and be obstructed by, the shoulder 224 while being so moved and therefore rotate in the rotating direction (e.g., clockwise) again (as shown in FIG. 13E). After the arresting block 27 has been rotated twice, the two second opposite sides of the arresting block 27 correspond to the two opposite sides (e.g., the upper and lower sides shown in FIG. 7) of the direction-changing groove 222 respectively. As the second length 142 defined by the two second opposite sides of the arresting block 27 is greater than the distance between the two opposite sides of the smooth groove 221, the arresting block 27 cannot extend into the smooth groove 221 but is retained at the junction between the smooth groove 221 and the direction-changing groove 222, thereby keeping the cigar cutter 2 in the closed state.

Figure 14A:
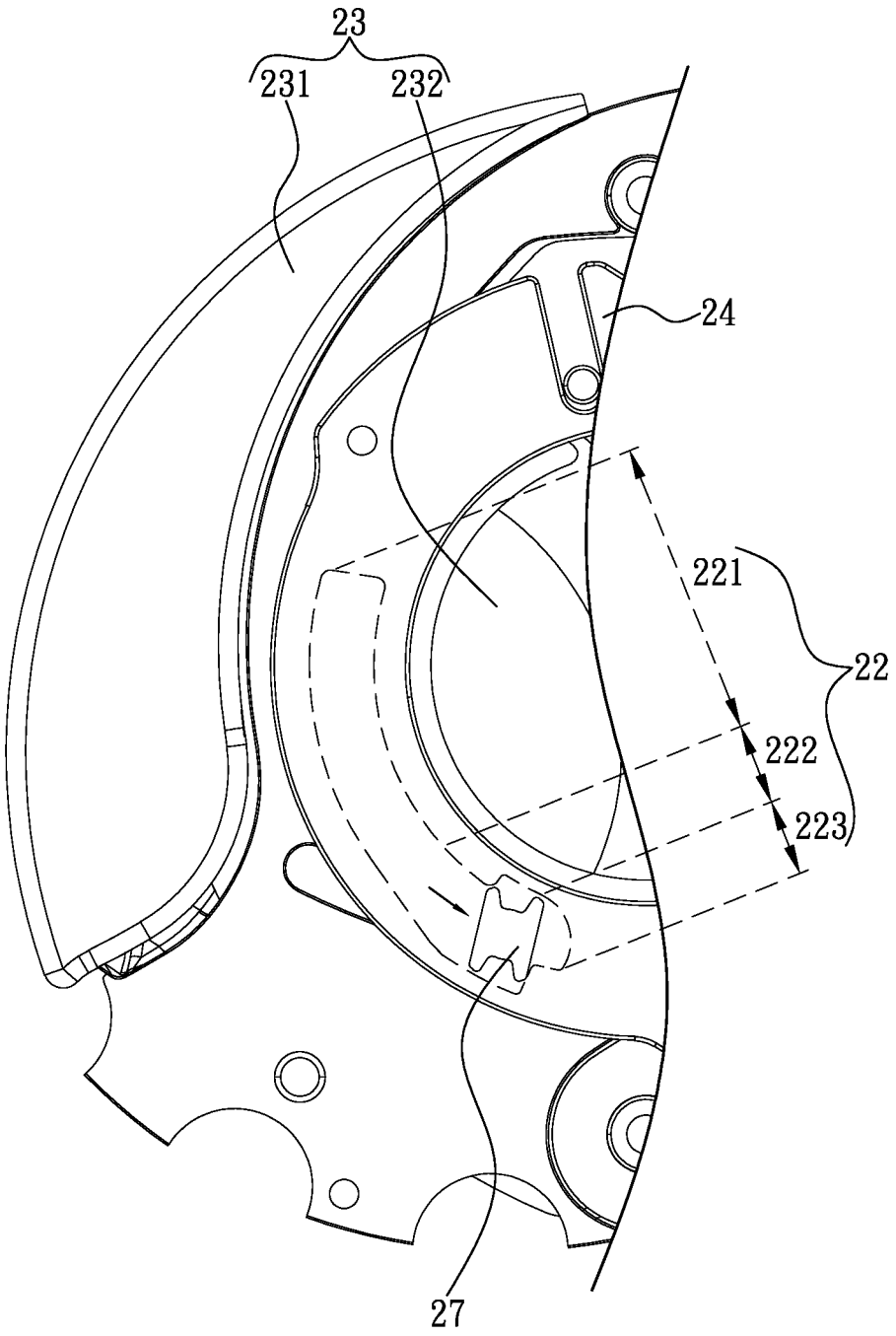
FIGS. 14A-14D are schematic diagrams showing the process of an arresting block being moved in a guide track when a cigar cutter enters into an open state from a closed state according to certain embodiments of the present disclosure.
Figure 14B:
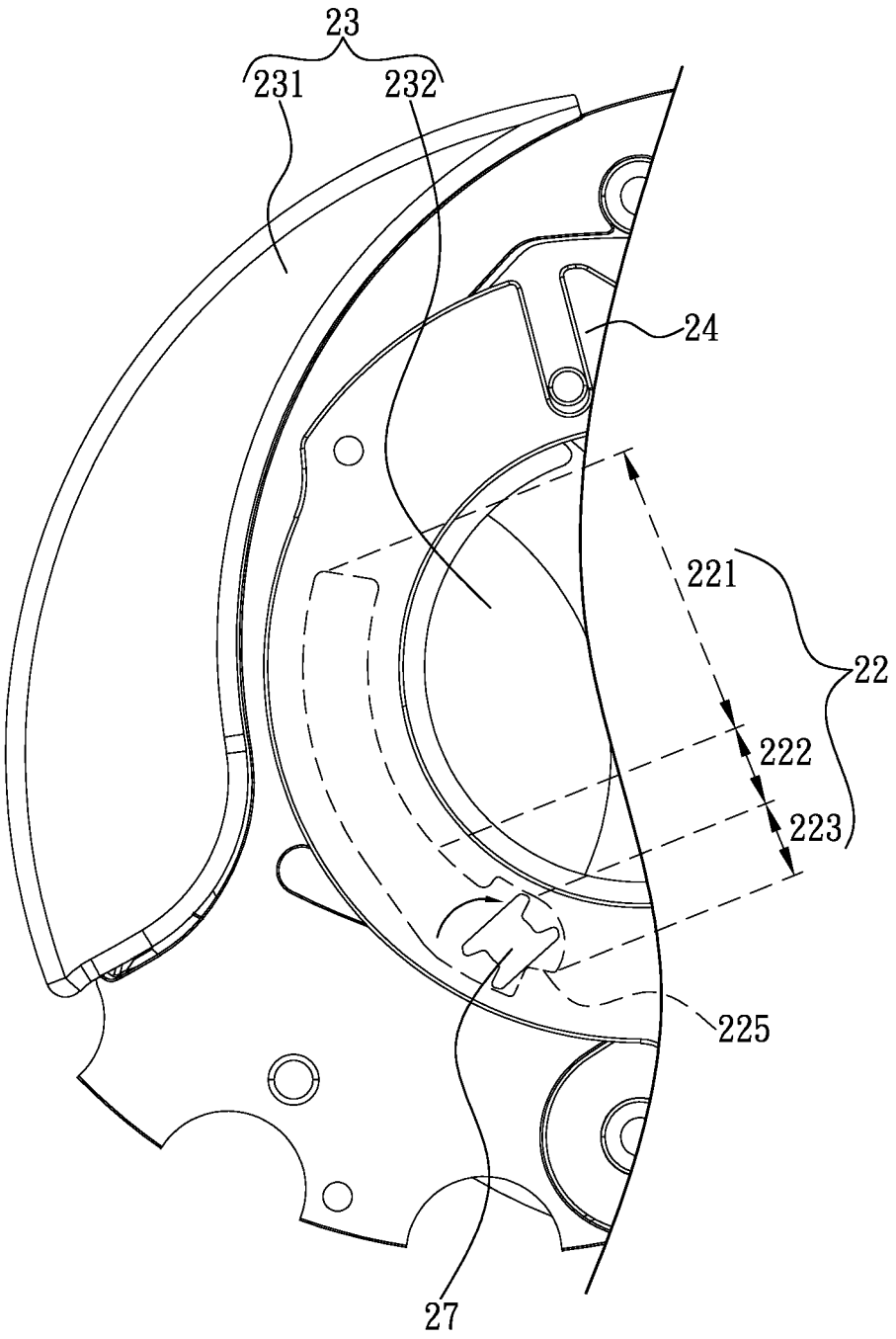
Figure 14C:
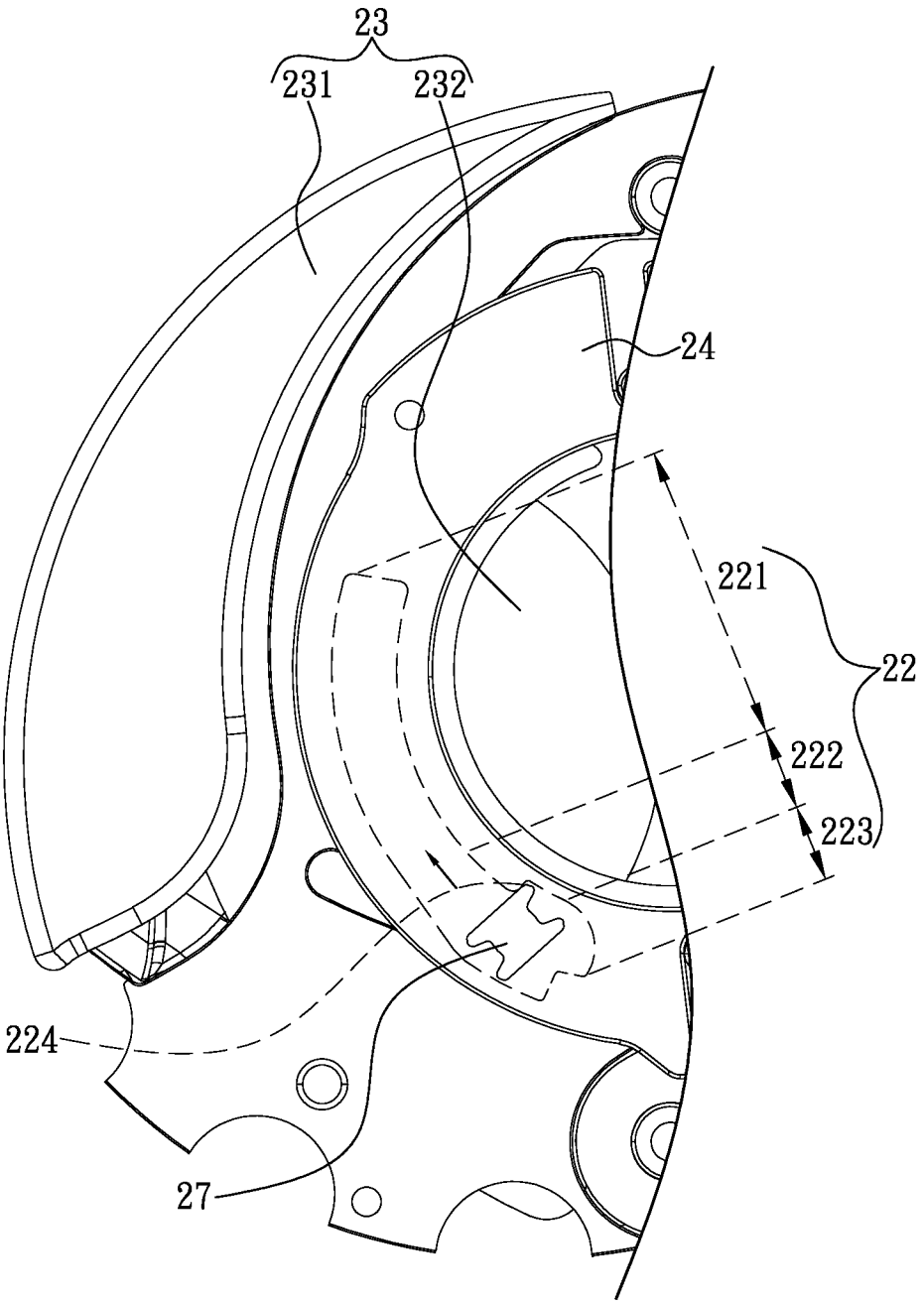
Figure 14D:
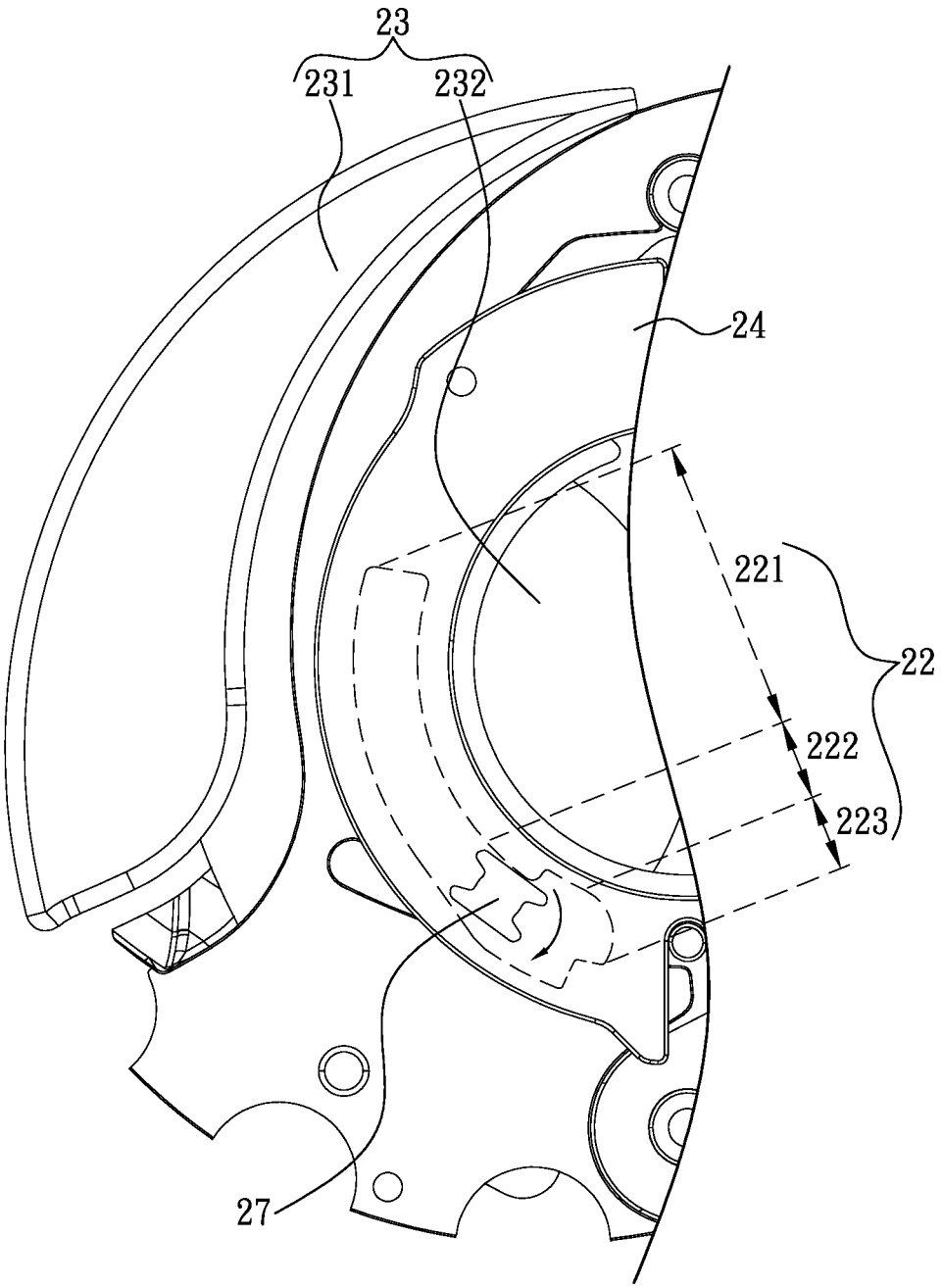

When it is desired to use the cigar cutter 2, the user presses the cutting blade units 23 once more so that the position-limiting posts 233 push the rotatable ring 24 to rotate and thus compress the elastic element 26 again. The arresting block 27 will stay in its current inclined position (with respect to the position of the arresting block 27 in FIG. 13A) and be moved from the direction-changing groove 222 toward the abutting groove 223 until touching, and obstructed by, the abutting block 225 (as shown in FIG. 14A). The obstruction causes the arresting block 27 to rotate in the rotating direction (e.g., clockwise) (as shown in FIG. 14B). Once the user's fingers are released, i.e., when the cutting blade units 23 are no longer pressed, the rotatable ring 24 is driven to rotate reversely by the restoring force of the elastic element 26 such that the cutting blade units 23 are moved outward. During the process, the arresting block 27 is moved from the abutting groove 223 toward the direction-changing groove 222 until touching, and obstructed by, the shoulder 224 (as shown in FIG. 14C), and the obstruction causes the arresting block 27 to rotate again in the rotating direction (e.g., clockwise) (as shown in FIG. 14D). After the arresting block 27 has been rotated twice, the two first opposite sides of the arresting block 27 correspond to the two opposite sides (e.g., the upper and lower sides shown in FIG. 7) of the direction-changing groove 222 respectively. As the first length H1 defined by the two first opposite sides of the arresting block 27 is equal to or less than the distance between the two opposite sides of the smooth groove 221, the arresting block 27 is allowed to extend into the smooth groove 221 (as shown in FIG. 13A), and the cigar cutter 2 enters into the open state (as shown in FIG. 4).

Figure 10:
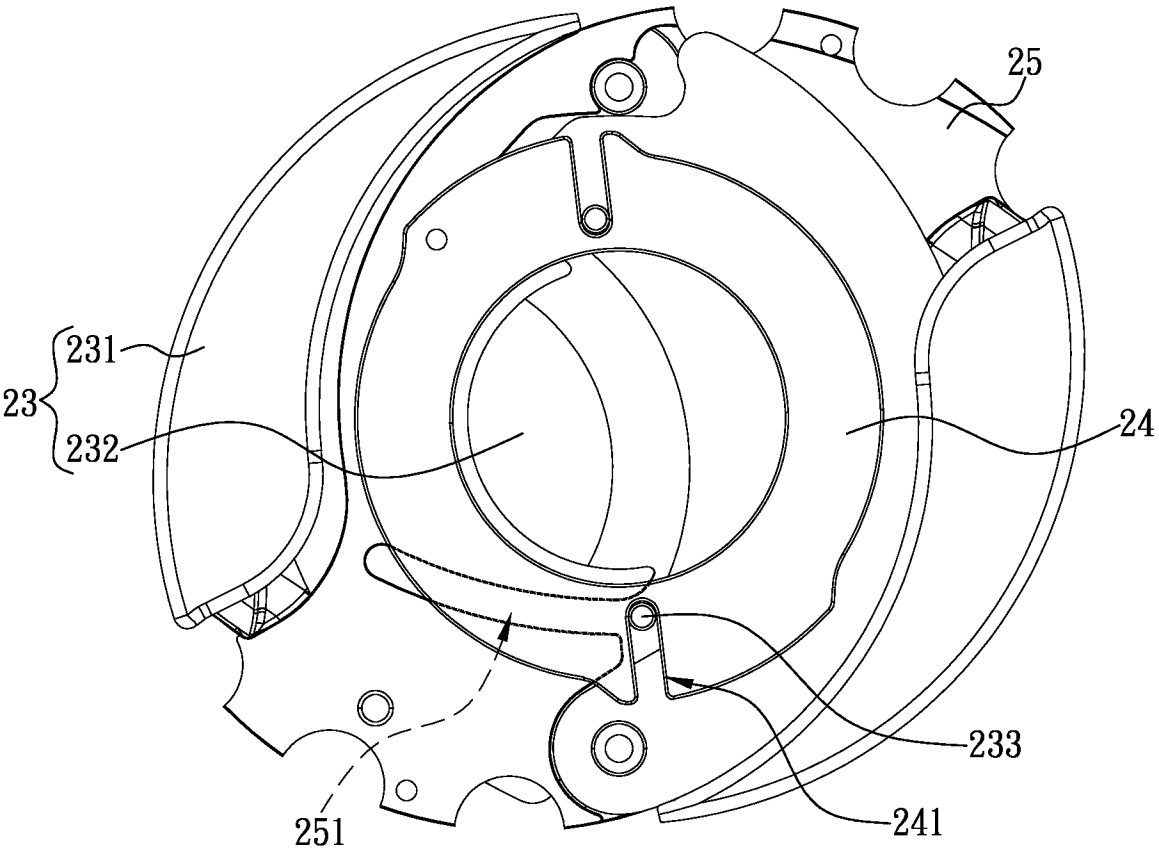
FIG. 10 is a schematic diagram of the position-limiting post being located at a second end of the first position-limiting track and a second end of the second position-limiting track according to certain embodiments of the present disclosure.

It can be known from the above that, referring to FIG. 3 and FIG. 10, the position-limiting posts 233, the rotatable ring 24, the elastic element 26, the arresting block 27, and the guide track 22 according to the present disclosure are so designed that the cigar cutter 2 can be switched between the closed state and the open state by the user pressing the cutting blade units 23 repeatedly. After using the cigar cutter 2, therefore, the user can easily keep the cigar cutter 2 in the closed state and store the cigar cutter 2 in a pocket or bag. The convenience and safety of use of the cigar cutter 2 are thus greatly enhanced in comparison with the prior art. Besides, as the second length H2 defined by the two second opposite sides of the arresting block 27 is greater than the first length H1 defined by the two first opposite sides of the arresting block 27, the longitudinal distance between the two opposite sides (e.g., the upper and lower sides shown in FIG. 7) of the direction-changing groove 222 is greater than the longitudinal distance between the two opposite sides (e.g., the upper and lower sides shown in FIG. 7) of the smooth groove 221 in order to provide a sufficiently large space in which the arresting block 27 can rotate.

Figure 15A:
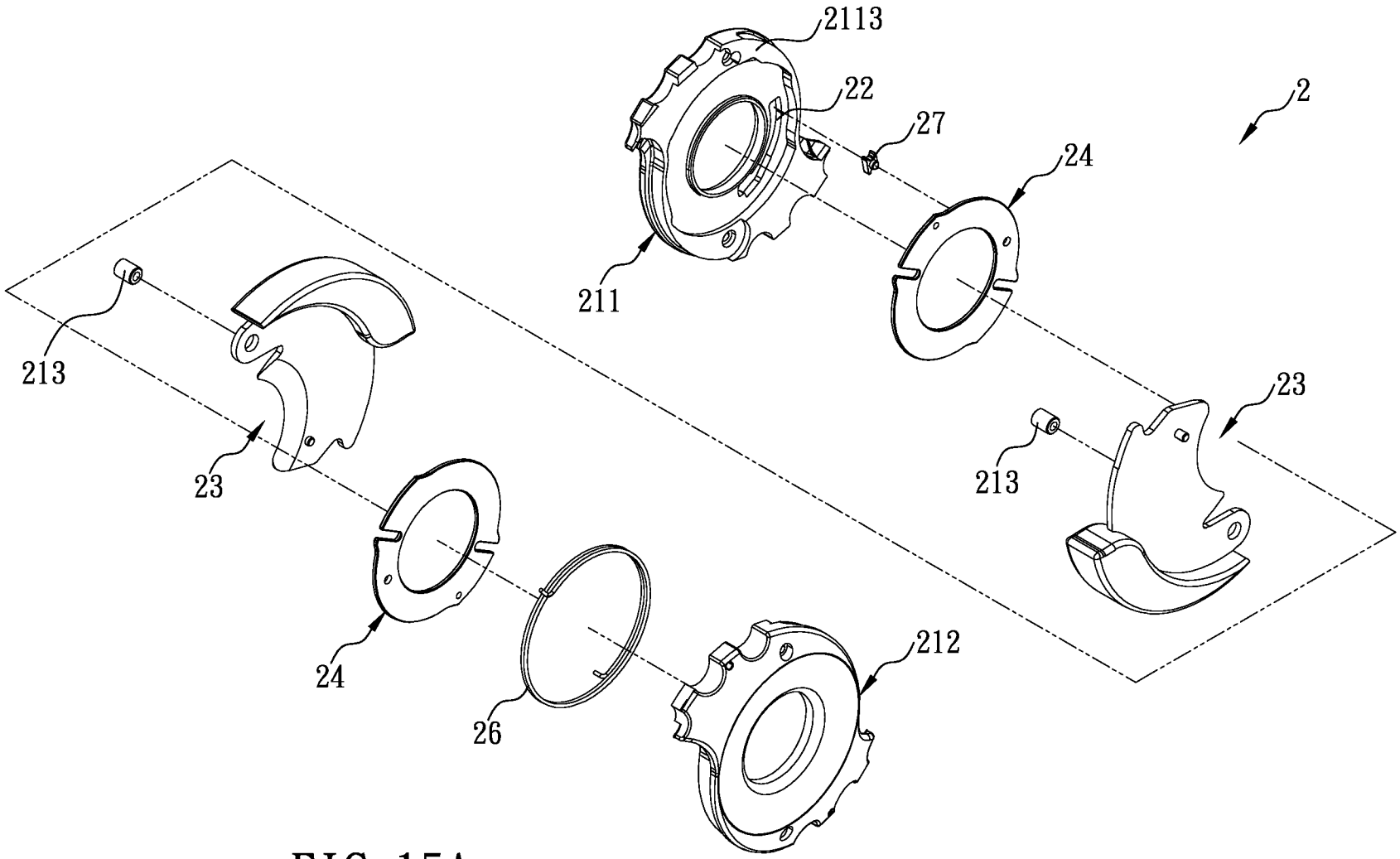
FIG. 15A is a rear exploded view of a cigar cutter according to certain embodiments of the present disclosure.
Figure 15B:
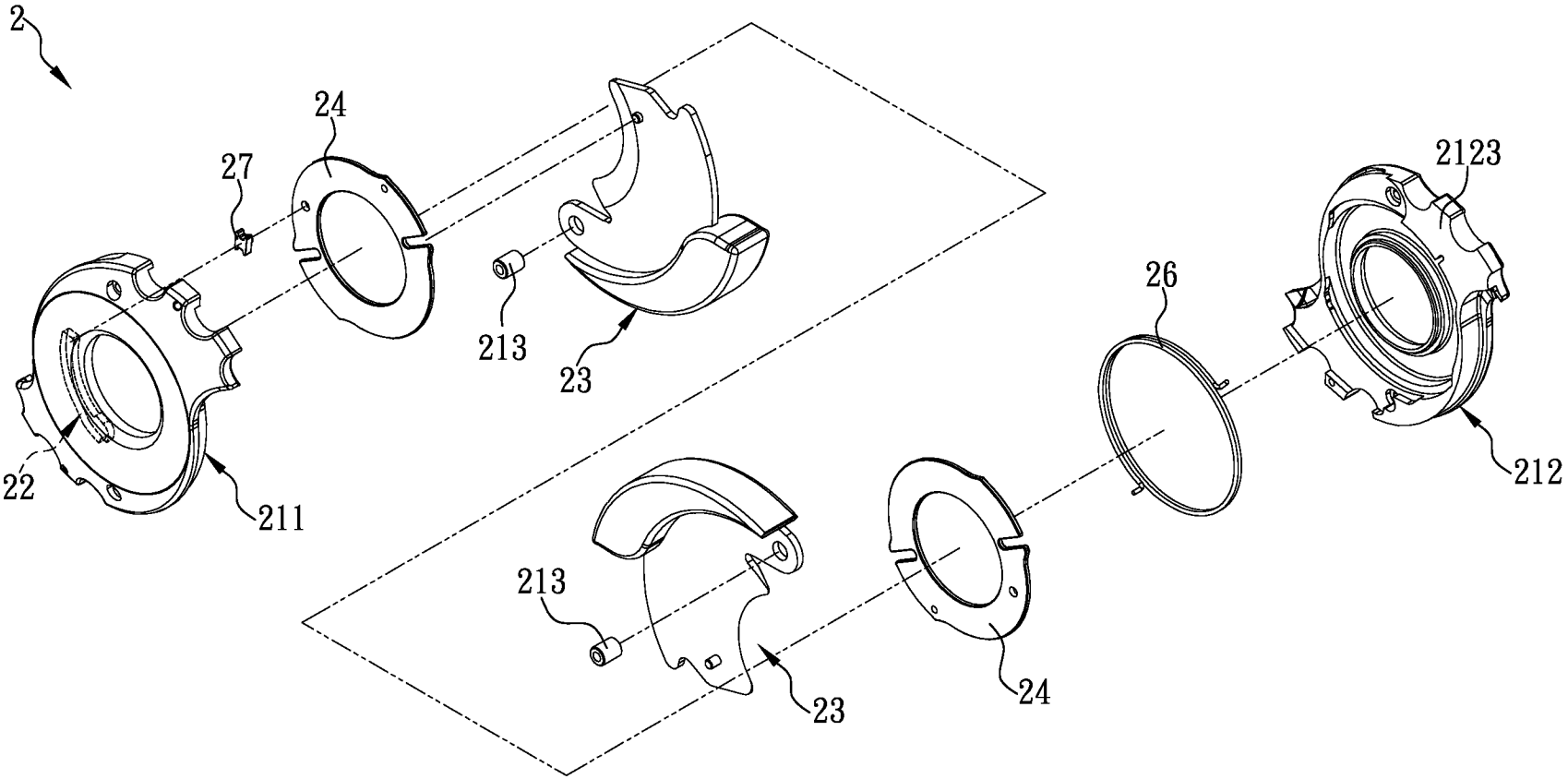
FIG. 15B is a front exploded view of a cigar cutter according to certain embodiments of the present disclosure.

In certain embodiments, the positioning ring 25 can be omitted from the cigar cutter 2 while retaining the functions of the afore-referenced closed state and open state of the cigar cutter 2. Referring to FIGS. 15A and 15B, for the cutting blade units 23 to move in a smoother fashion without tilting, an area of the rear side of the front cover 211 (for example, an area that is closer to the right side of FIG. 15A) can have a front protruding block 2113, and an area of the front side of the rear cover 212 (for example, an area that is closer to the right side of FIG. 15B) can have a rear protruding block 2123. When the front cover 211 and the rear cover 212 are assembled with each other, the front protruding block 2113 and the rear protruding block 2123 are not aligned with each other and do not correspond in position to each other. For example, when the front protruding portion 2113 is located at a position at the left side of the front cover 211, the rear protruding portion 2123 is located at a position at the right side of the rear cover 212. In certain embodiments, a protruding thickness degree of the front protruding block 2113 and a protruding thickness degree of the rear protruding block 2123 are the same or substantially the same. The protruding thickness degree of the front protruding block 2113 is defined as a vertical distance of the front protruding block 2113 extending rearwards with respect to a location on the rear side of the front cover 211 that is different from that of the front protruding block 2113. The protruding thickness degree of the rear protruding block 2123 is defined as a vertical distance of the rear protruding block 2123 extending frontwards with respect to a location on the front side of the rear cover 212 that is different from that of the rear protruding block 2123.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A cigar cutter, comprising:

a main body formed with a first through hole and provided therein with at least one guide track divided at least into a smooth groove, a direction-changing groove, and an abutting groove, wherein one end of the direction-changing groove is in communication with an end of the smooth groove, the other end of the direction-changing groove is in communication with an end of the abutting groove, one side of the direction-changing groove has a shoulder, one side of the abutting groove that is opposite to the shoulder is formed with an abutting block, and a portion of the abutting block corresponds to a space between two opposite sides of the smooth groove;

a rotatable ring configured to be movably located in the main body, and formed with at least one first position-limiting track and a second through hole that corresponds to the first through hole;

an elastic element configured to be located in the main body, having one end configured to be fixed to a first positioning portion of the main body, and another end configured to be fixed to a second positioning portion of the rotatable ring;

at least one cutting blade unit configured to be movably mounted on the main body, having one side configured to be exposed from the main body and the other side configured to extend into the main body, and having a position-limiting post, wherein the elastic element is configured to be compressed when the at least one cutting blade unit is displaced along a direction towards the main body, and to push the at least one cutting blade unit away from the main body and drive the rotatable ring to rotate reversely so that the cigar cutter enters an open state, the first position-limiting track is configured to allow the position-limiting post to extend and slide therein, and the position-limiting post is configured to:

when the at least one cutting blade unit is moved along the direction towards the main body, slide from a first end of the first position-limiting track towards a second end of the first position-limiting track and push the rotatable ring to rotate so as to compress the elastic element until the cigar cutter enters a closed state, wherein the at least one cutting blade unit covers the first through hole and the second through hole in the closed state; and when the at least one cutting blade unit is driven by the elastic element to move along a direction away from the main body, slide from the second end of the first position-limiting track towards the first end of the first position-limiting track through reverse rotation of the rotatable ring driven by the elastic element, so that the at least one cutting blade unit enters the open state, wherein the first through hole and the second through hole are not covered by the at least one cutting blade unit in the open state; and an arresting block having a first length between two first opposite sides of the arresting block that is equal to or less than a distance between the two opposite sides of the smooth groove, and a second length that is greater than the distance between the two opposite sides of the smooth groove and defined as a maximum distance between two second opposite sides of the arresting block that are other than the two first opposite sides, and is configured to:

be pivotally connected to the rotatable ring;

extend into the guide track;

move in the guide track in response to rotation of the rotatable ring;

when the cigar cutter is in the open state, be located in the smooth groove with the two first opposite sides of the arresting block corresponding to the two opposite sides of the smooth groove, respectively;

when the at least one cutting blade unit is pressed and the elastic element is compressed, move from the smooth groove along a direction towards the abutting groove until touching the abutting block;

rotate in a rotating direction in response to touching the abutting block;

when the at least one cutting blade unit is not pressed and the rotatable ring is driven to rotate reversely by a restoring force of the elastic element, move along a direction from the abutting groove towards the direction-changing groove until touching the shoulder; and in response to touching the shoulder, rotate in the rotating direction so that the two second opposite sides of the arresting block correspond to two opposite sides of the direction-changing groove respectively to keep the two second opposite sides of the arresting block from extending into the smooth groove and the cigar cutter in the closed state.

2. The cigar cutter according to claim 1, wherein the arresting block is further configured to:

when the cigar cutter is in the closed state, the at least one cutting blade unit is pressed and the elastic element is compressed, move along a direction from the direction-changing groove towards the abutting groove until touching the abutting block;

rotate in the rotating direction in response to touching the abutting block;

when the at least one cutting blade unit is not pressed and the rotatable ring is driven to rotate reversely by the restoring force of the elastic element to push the at least one cutting blade unit to move, move along the direction from the abutting groove towards the direction-changing groove until touching the shoulder; and in response to touching the shoulder, rotate in the rotating direction so that the two first opposite sides of the arresting block correspond to the two opposite sides of the direction-changing groove respectively and extend into the smooth groove and the cigar cutter enters the open state.

3. The cigar cutter according to claim 2, wherein a longitudinal distance between the two opposite sides of the direction-changing groove is greater than a longitudinal distance between the two opposite sides of the smooth groove.

4. The cigar cutter according to claim 2, wherein the main body comprises a front cover formed with a front through hole, and a rear cover formed with a rear through hole, wherein the front through hole and the rear through hole jointly form the first through hole.

5. The cigar cutter according to claim 2, wherein the guide track has an arcuate shape.

6. The cigar cutter according to claim 2, further comprising a positioning ring configured to be located in the main body, and formed with a third through hole and at least one second position-limiting track, wherein the third through hole corresponds to the first through hole, and the position-limiting post is configured to:

extend into, and slide in, the first position-limiting track and the second position-limiting track;

when the at least one cutting blade unit is moved along the direction towards the main body, slide from a first end of the second position-limiting track towards a second end of the second position-limiting track and push the rotatable ring to rotate until the cigar cutter enters the closed state, wherein the at least one cutting blade unit covers the first through hole, the second through hole and the third through hole in the closed state; and when the elastic element drives the rotatable ring to rotate reversely, slide from the second end of the second position-limiting track towards the first end of the second position-limiting track, so that the at least one cutting blade unit enters the open state, wherein the first through hole, the second through hole and the third through hole are not covered by the at least one cutting blade unit in the open state.

7. The cigar cutter according to claim 1, wherein each of the two second opposite sides of the arresting block is inwardly formed with a recess.

8. The cigar cutter according to claim 7, wherein a longitudinal distance between the two opposite sides of the direction-changing groove is greater than a longitudinal distance between the two opposite sides of the smooth groove.

9. The cigar cutter according to claim 7, wherein the main body comprises a front cover formed with a front through hole, and a rear cover formed with a rear through hole, wherein the front through hole and the rear through hole jointly form the first through hole.

10. The cigar cutter according to claim 7, wherein the guide track has an arcuate shape.

11. The cigar cutter according to claim 7, further comprising a positioning ring configured to be located in the main body, and formed with a third through hole and at least one second position-limiting track, wherein the third through hole corresponds to the first through hole, and the position-limiting post is configured to:

extend into, and slide in, the first position-limiting track and the second position-limiting track;

when the at least one cutting blade unit is moved along the direction towards the main body, slide from a first end of the second position-limiting track towards a second end of the second position-limiting track and push the rotatable ring to rotate until the cigar cutter enters the closed state, wherein the at least one cutting blade unit covers the first through hole, the second through hole and the third through hole in the closed state; and when the elastic element drives the rotatable ring to rotate reversely, slide from the second end of the second position-limiting track towards the first end of the second position-limiting track, so that the at least one cutting blade unit enters the open state, wherein the first through hole, the second through hole and the third through hole are not covered by the at least one cutting blade unit in the open state.

12. The cigar cutter according to claim 1, wherein the rotating direction is clockwise.

13. The cigar cutter according to claim 1, wherein a longitudinal distance between the two opposite sides of the direction-changing groove is greater than a longitudinal distance between the two opposite sides of the smooth groove.

14. The cigar cutter according to claim 1, wherein the main body comprises a front cover formed with a front through hole, and a rear cover formed with a rear through hole, wherein the front through hole and the rear through hole jointly form the first through hole.

15. The cigar cutter according to claim 1, wherein the guide track has an arcuate shape.

16. The cigar cutter according to claim 1, further comprising a positioning ring configured to be located in the main body, and formed with a third through hole and at least one second position-limiting track, wherein the third through hole corresponds to the first through hole, and the position-limiting post is configured to:

extend into, and slide in, the first position-limiting track and the second position-limiting track;

when the at least one cutting blade unit is moved along the direction towards the main body, slide from a first end of the second position-limiting track towards a second end of the second position-limiting track and push the rotatable ring to rotate until the cigar cutter enters the closed state, wherein the at least one cutting blade unit covers the first through hole, the second through hole and the third through hole in the closed state; and when the elastic element drives the rotatable ring to rotate reversely, slide from the second end of the second position-limiting track towards the first end of the second position-limiting track, so that the at least one cutting blade unit enters the open state, wherein the first through hole, the second through hole and the third through hole are not covered by the at least one cutting blade unit in the open state.

* * * * *